US012044227B2

(12) United States Patent
Hirayama et al.

(10) Patent No.: US 12,044,227 B2
(45) Date of Patent: Jul. 23, 2024

(54) AIR COMPRESSOR

(71) Applicant: MAKITA CORPORATION, Anjo (JP)

(72) Inventors: Toshiro Hirayama, Anjo (JP); Noriyuki Nishido, Anjo (JP); Tomohiro Hachisuka, Anjo (JP); Yasutoshi Kurokawa, Anjo (JP); Makito Teramoto, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/948,959

(22) Filed: Sep. 20, 2022

(65) Prior Publication Data

US 2023/0151803 A1 May 18, 2023

(30) Foreign Application Priority Data

Nov. 16, 2021 (JP) ..... 2021-186204

(51) Int. Cl.

| | |
|---|---|
| ***F04B 39/16*** | (2006.01) |
| ***F04B 27/053*** | (2006.01) |
| ***F04B 35/01*** | (2006.01) |
| ***F04B 35/04*** | (2006.01) |
| ***F04B 39/00*** | (2006.01) |

(Continued)

(52) U.S. Cl.

CPC ..... *F04B 39/16* (2013.01); *F04B 27/053* (2013.01); *F04B 35/01* (2013.01); *F04B 35/04* (2013.01); *F04B 39/121* (2013.01); *F04B 39/128* (2013.01); *F04B 39/14* (2013.01); *F04B 39/0038* (2013.01); *F04B 39/0072* (2013.01)

(58) Field of Classification Search

CPC ..... F04B 39/16; F04B 27/053; F04B 35/01; F04B 35/04; F04B 39/121; F04B 39/128; F04B 39/14; F04B 39/0038; F04B 39/0055; F04B 39/0072; F04B 39/0016

See application file for complete search history.

(56) References Cited

U.S. PATENT DOCUMENTS 1,872,805 A * 8/1932 Peterson ..... F04B 35/06 417/415

2003/0206816 A1* 11/2003 Chen ..... F04B 35/04 417/415

(Continued)

FOREIGN PATENT DOCUMENTS

JP 5186799 B2 4/2013

*Primary Examiner* — Charles G Freay
*Assistant Examiner* — David N Brandt
(74) *Attorney, Agent, or Firm* — Oliff PLC

(57) ABSTRACT

An air compressor improves the dustproof performance of an intake path to a crankcase. The air compressor includes a compression assembly that reciprocates a piston in a cylinder to produce compressed air, a crankcase accommodating the compression assembly and having an inner inlet to allow outside air to be drawn, a filter located in the crankcase and covering the inner inlet from outside, a filter cover having an outer inlet and covering the filter from outside, and a dust cover covering the filter cover from outside, covering the outer inlet, and including an outer circumferential portion. The outer circumference portion and the filter cover have a space to draw outside air between the outer circumference portion and the filter cover.

20 Claims, 19 Drawing Sheets

(51) Int. Cl.
*F04B 39/12* (2006.01)
*F04B 39/14* (2006.01)

(56) References Cited

U.S. PATENT DOCUMENTS

2006/0045768 A1* 3/2006 Chuang ..... F04B 39/128
417/415
2008/0236116 A1* 10/2008 Kawasaki ..... B01D 45/06
55/385.4
2021/0222684 A1* 7/2021 Zhu ..... F16F 15/315

* cited by examiner

AIR COMPRESSOR

CROSS-REFERENCE TO RELATED APPLICATIONS

This application claims the benefit of priority to Japanese Patent Application No. 2021-186204, filed on Nov. 16, 2021, the entire contents of which are hereby incorporated by reference.

BACKGROUND

1. Technical Field

The present disclosure relates to an air compressor for supplying compressed air to an air tool, such as a compressed air-driven nailer or an air duster.

2. Description of the Background

A technique for an air compressor is described in Japanese Patent No. 5186799 (hereafter, Patent Literature 1). The air compressor includes a reciprocating compression assembly for producing compressed air. A known compression assembly converts rotational output from an electric motor with a crank assembly into reciprocation of a piston in a cylinder to produce compressed air. The compressed air produced in the compression assembly is stored into a tank. The compressed air stored in the tank is supplied to an air tool.

Outside air to produce such compressed air is drawn into a crankcase accommodating the crank assembly. Thus, a filter for reducing noise and dust is installed on an intake path for drawing outside air into the crankcase. With the technique in Patent Literature 1, the filter is attached to a crankcase cover that hermetically closes an end of the crankcase. The filter covers multiple inlets in the crankcase cover. The dust filter is held by a filter cover coupled to the crankcase cover. Outside air is then drawn into the inlets through a space between the peripheries of the filter cover and the crankcase cover. The intake path is thus bent, reducing noise resulting from external leakage of the operation noise of the compression assembly.

BRIEF SUMMARY

In addition to reducing noise, the air compressor is to protect the inside of the crankcase from dust. In particular, the air compressor with its intake path being protected from dust has higher maintainability and durability.

One or more aspects of the present disclosure are directed to a technique for improving the dustproof performance of an intake path to a crankcase.

A first aspect of the present disclosure provides an air compressor, including:

a compression assembly configured to reciprocate a piston in a cylinder to produce compressed air;

a crankcase accommodating the compression assembly and having an inner inlet to allow outside air to be drawn;

a filter located in the crankcase and covering the inner inlet from outside;

a filter cover having an outer inlet and covering the filter from outside; and a dust cover covering the filter cover from outside, covering the outer inlet, and including an outer circumferential portion, the outer circumference portion and the filter cover having a space to draw outside air between the outer circumference portion and the filter cover.

The air compressor according to the above aspect of the present disclosure improves the dustproof performance of an intake path to the crankcase.

DETAILED DESCRIPTION

Embodiments

Figure 1:
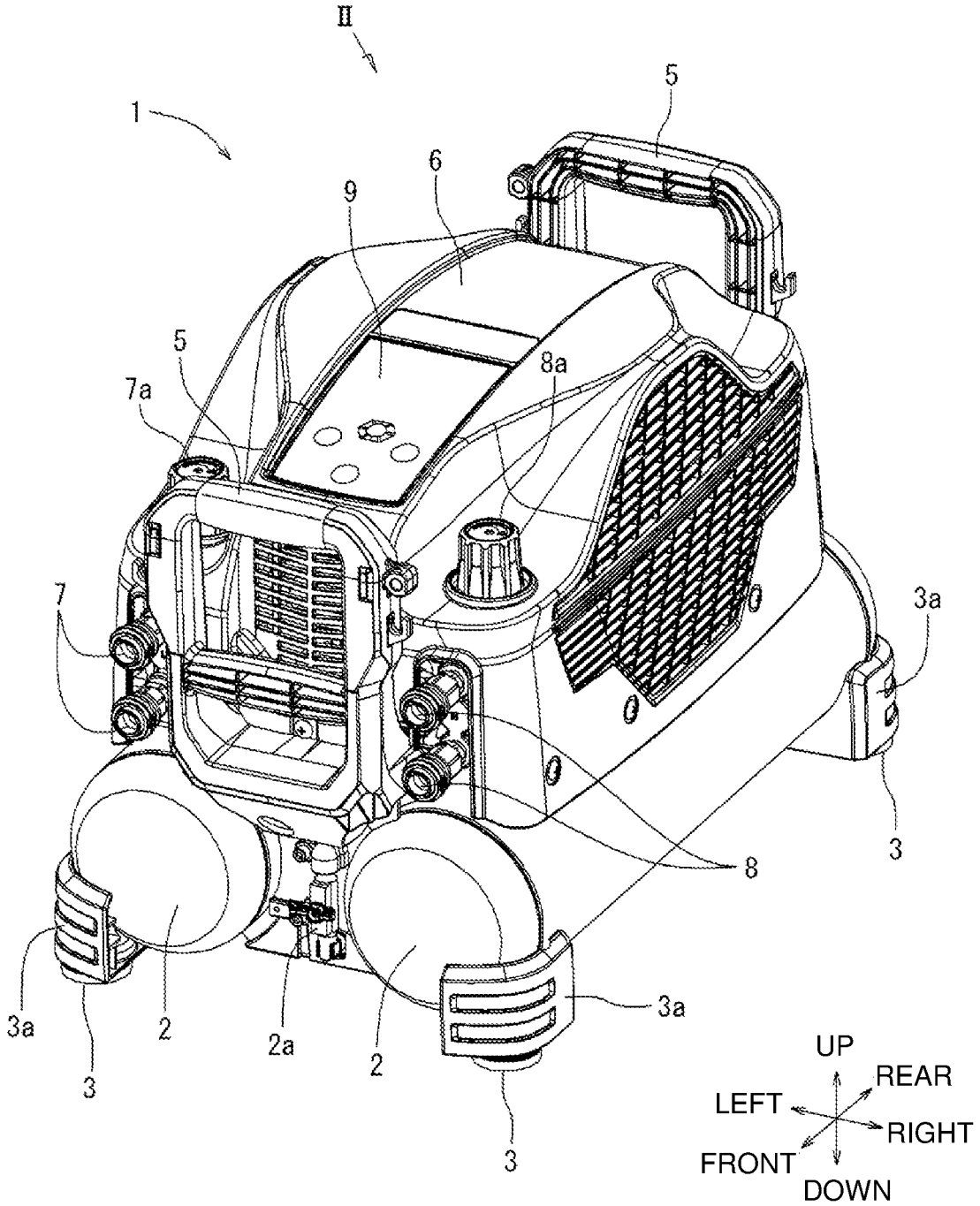
FIG. 1 is an external perspective view of an air compressor.
Figure 2:
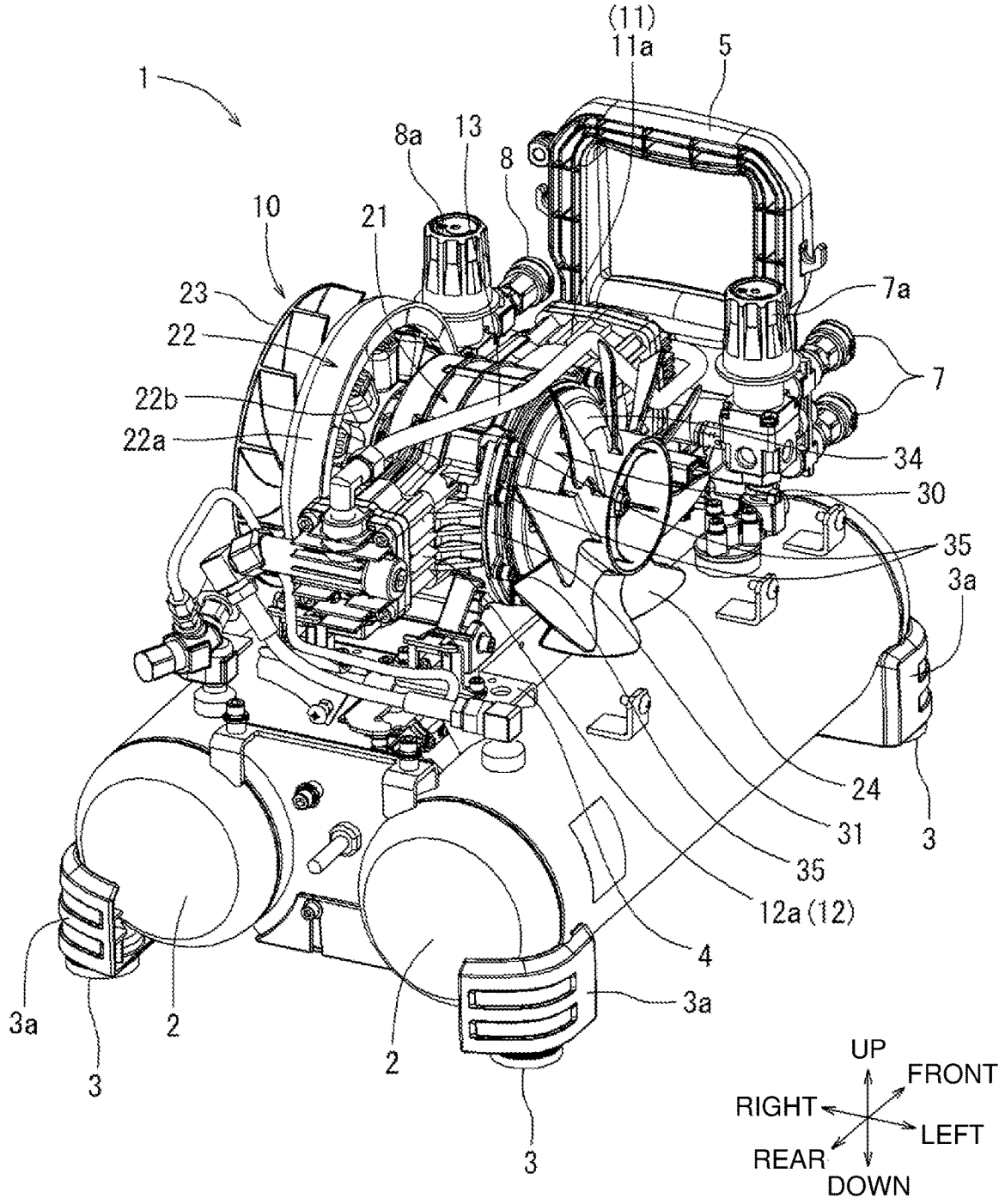
FIG. 2 is a view of the air compressor with a body cover removed and a compression assembly exposed as viewed diagonally from the left rear in the direction indicated by arrow II in FIG. 1.

As shown in FIGS. 1 and 2, an air compressor 1 includes two cylindrical tanks 2 extending in the front-rear direction. The two tanks 2 store produced compressed air. The two tanks 2 include four legs 3 in total on their front and rear portions. Each leg 3 is formed from high vibration-proof rubber. Each leg 3 is adjacent to a side protector 3*a*. A drain cock 2*a* is located between the front portions of the two tanks 2. The two tanks 2 include upper portions coupled to each other with a base 4. The base 4 receives a compression assembly 10 mounted on its upper surface. Carrying handles 5 are located in front of and behind the base 4 and each extend across the upper portions of the two tanks 2. FIG. 1 shows the compression assembly 10 covered with a body cover 6.

The body cover 6 has two outlet ports 7 for high-pressure air on its front left surface. The body cover 6 has two outlet ports 8 for low-pressure air on its front right surface. Through the outlet ports 7 for high-pressure air, for example, compressed air of 2.5 MPa is supplied. Through the outlet ports 8 for low-pressure air, for example, compressed air of 1 MPa is supplied. Adjustment dials 7*a* and 8*a* are located above the outlet ports 7 and 8 to set their respective outlet pressures. The body cover 6 includes, on its upper front surface, an operation unit 9 operable for activation. The operation unit 9 includes various displays.

Figure 3:
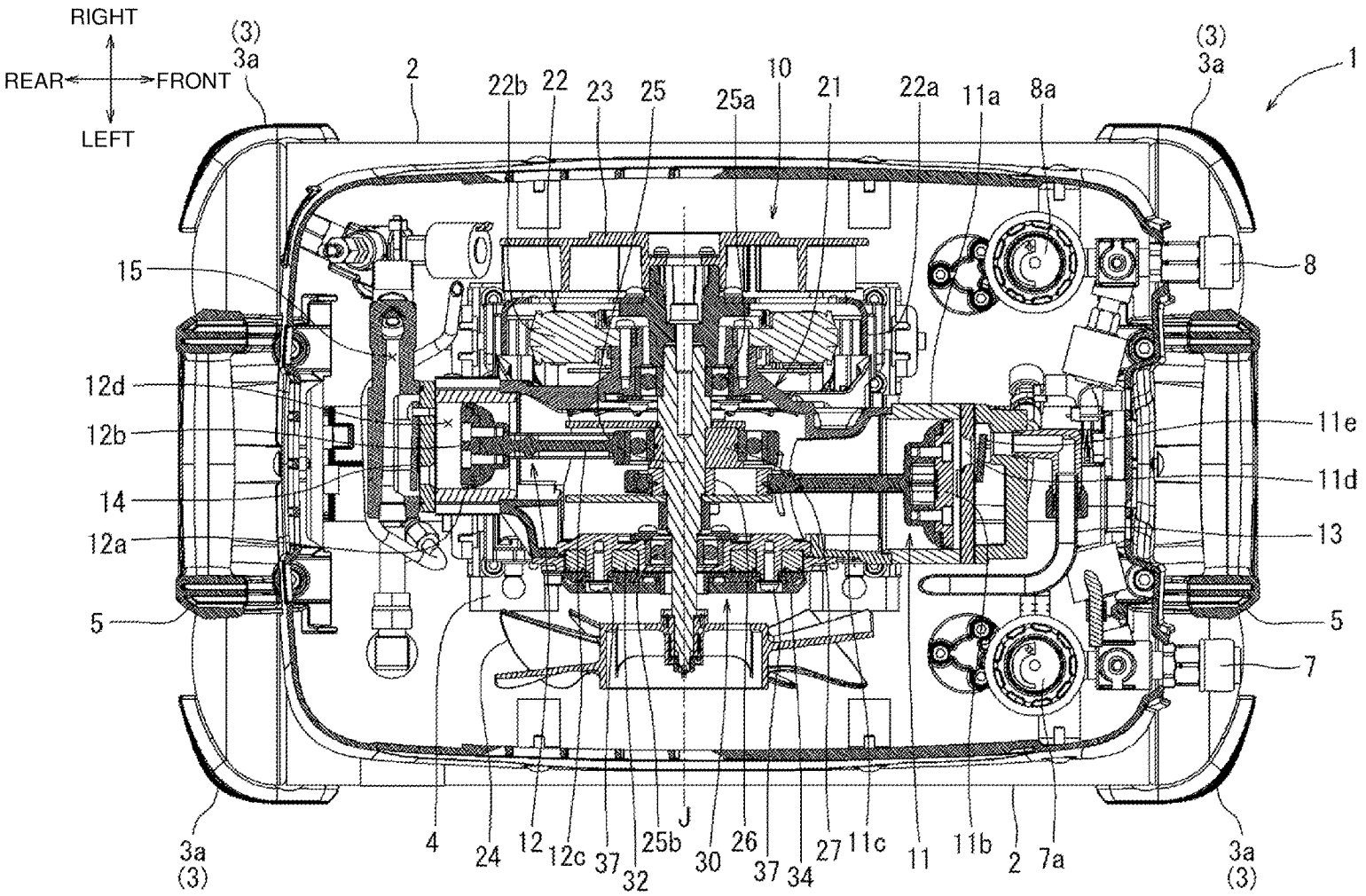
FIG. 3 is a sectional view of the compression assembly.

As shown in FIG. 2, the body cover 6 is removed to expose the compression assembly 10. As shown in FIGS. 2 and 3, the compression assembly 10 includes a cylindrical crankcase 21 including a front first compressor 11 and a rear second compressor 12. The crankcase 21 supports, on its right, an electric motor 22 between the first compressor 11 and the second compressor 12. The crankcase 21 is fixed on the base 4.

The electric motor 22 is a brushless motor that produces relatively large activation torque. The electric motor 22 includes an annular rotor 22*a* and an annular stator 22*b*. The stator 22*b* is located inward from the circumference of the rotor 22*a*. The stator 22*b* is fixed to a right portion of the crankcase 21. A motor shaft 25 is coupled to the rotor 22*a* at the center. The motor shaft 25 has a right end receiving a heat-dissipating fan 23. The heat-dissipating fan 23 rotates to dissipate heat generated in the electric motor 22 and cool the electric motor 22. The motor shaft 25 extends leftward through the center of the stator 22*b*. The motor shaft 25 is rotatably supported across right and left portions of the crankcase 21 with a right bearing 25*a* and a left bearing 25*b*. The motor shaft 25 has a left end protruding leftward through an intake unit 30. The motor shaft 25 has the left end receiving an intake fan 24. The intake fan 24 rotates to blow outside air against the intake unit 30.

The cylindrical crankcase 21 includes a front portion coupled to a first cylinder 11*a* in the first compressor 11. The crankcase 21 includes a rear portion coupled to a second cylinder 12*a* in the second compressor 12. The internal space of the crankcase 21 allows passage of outside air.

The first cylinder 11*a* accommodates a first piston 11*b* to allow reciprocation in the front-rear direction. The first cylinder 11*a* extends frontward from the front portion of the crankcase 21. The first piston 11*b* is coupled to a first crank 26 in the motor shaft 25 with a first rod 11*c*.

The second cylinder 12*a* accommodates a second piston 12*b* to allow reciprocation in the front-rear direction. The second cylinder 12*a* extends rearward from the rear portion of the crankcase 21. The second piston 12*b* is coupled to a second crank 27 in the motor shaft 25 with a second rod 12*c*.

The first crank 26 and the second crank 27 are decentered in the same direction at the same position about the axis of the motor shaft 25. As the motor shaft 25 rotates once, one of the first compressor 11 and the second compressor 12 performs a compression process, and the other compressor performs an intake process at the same time. In the compression process in which the first piston 11*b* in the first compressor 11 moves forward, the second piston 12*b* in the second compressor 12 moves forward to perform the intake process. In the intake process in which the first piston 11*b* in the first compressor 11 moves backward, the second piston 12*b* in the second compressor 12 moves backward to perform the compression process.

The first cylinder 11*a* includes a first compression chamber 11*d* that connects to a second compression chamber 12*d* in the second cylinder 12*a* with a supply pipe 13. The supply pipe 13 has an upstream end connected to the first compression chamber 11*d* with an auxiliary check valve 11*e*. The auxiliary check valve 11*e* blocks compressed air without allowing flowing back from the supply pipe 13 into the first compression chamber 11*d*. The supply pipe 13 has a downstream end connected to the second compression chamber 12*d*. The compressed air flowing from the first compression chamber 11*d* through the auxiliary check valve 11*e* into the supply pipe 13 is directly supplied to the second compression chamber 12*d*.

In response to activation of the electric motor 22, compressed air is produced in two steps, which are through the first compressor 11 and the second compressor 12. The compressed air supplied to the second compression chamber 12*d* is compressed to a higher pressure in response to retraction of the second piston 12*b*. The high-pressure compressed air of, for example, about 4.5 MPa produced in the second compression chamber 12*d* flows into an air channel 15 extending to the tanks 2 through a first check valve 14. The first check valve 14 blocks the compressed air flowing into the air channel 15 without flowing back into the second compression chamber 12*d*.

The crankcase 21 is adjacent to the intake unit 30 on its left. Outside air is drawn into the crankcase 21 through the intake unit 30.

First Embodiment

Figure 4:
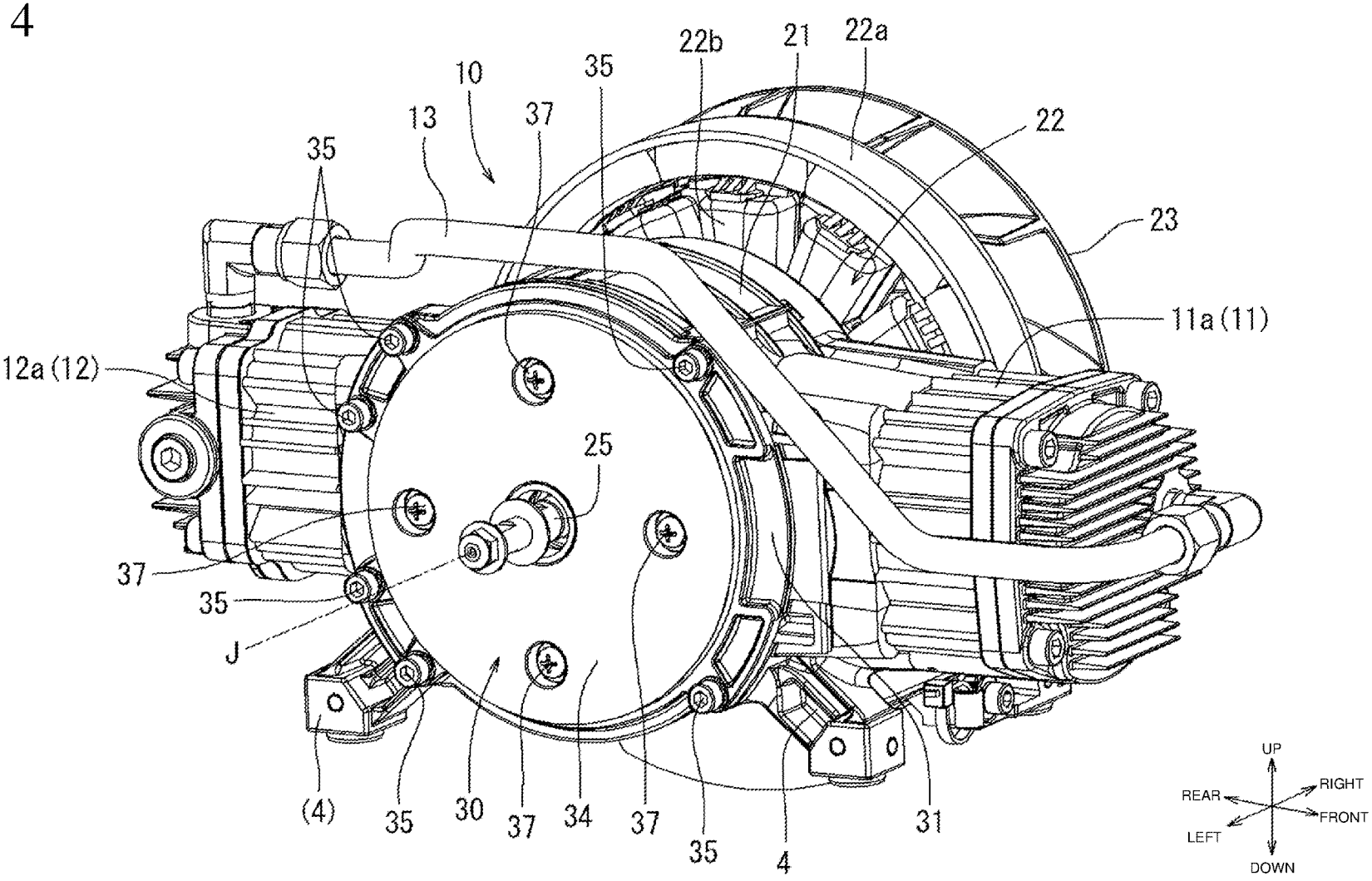
FIG. 4 is a perspective view of an intake unit in a first embodiment.
Figure 5:
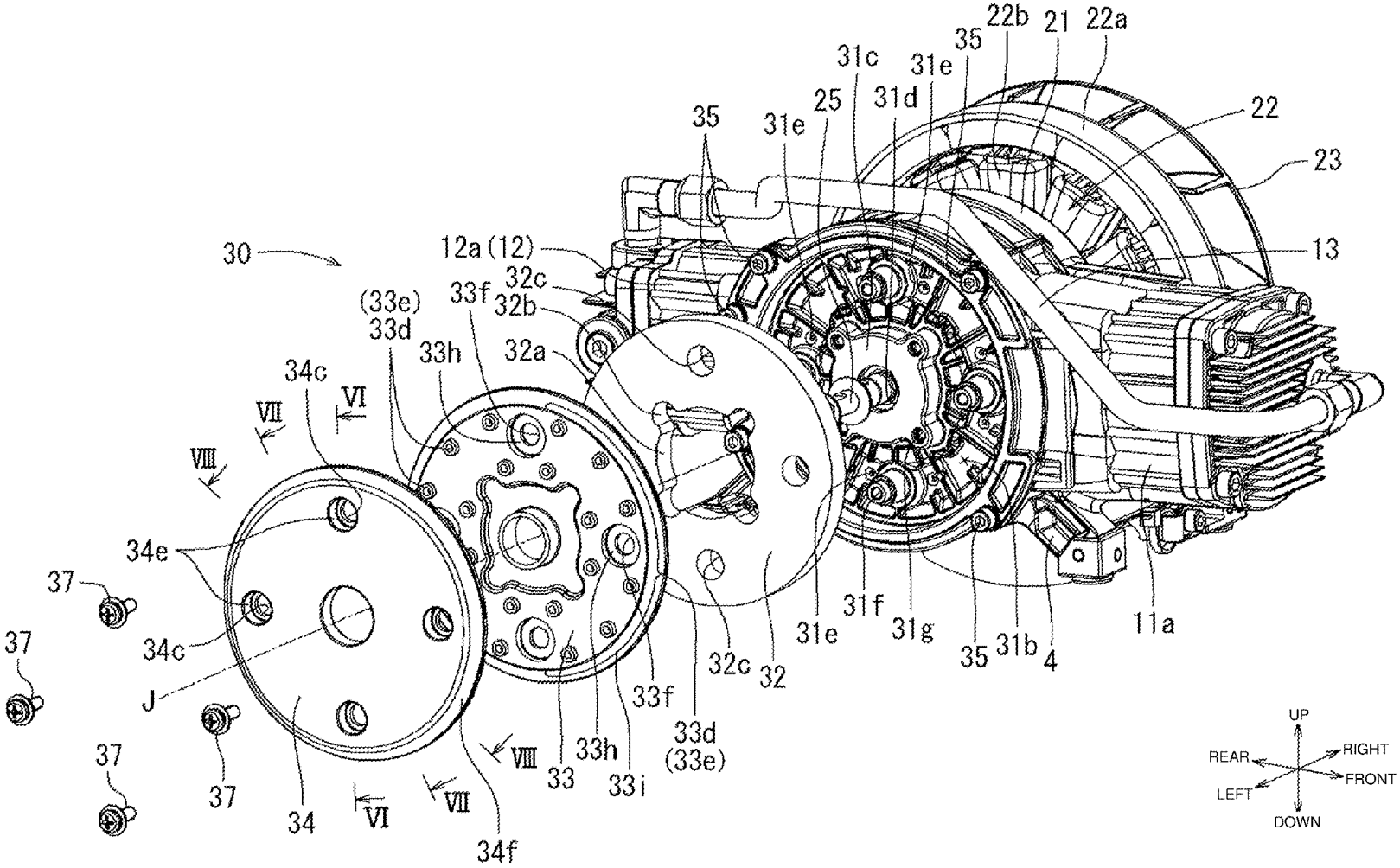
FIG. 5 is an exploded perspective view of the intake unit in the first embodiment.
Figure 6:
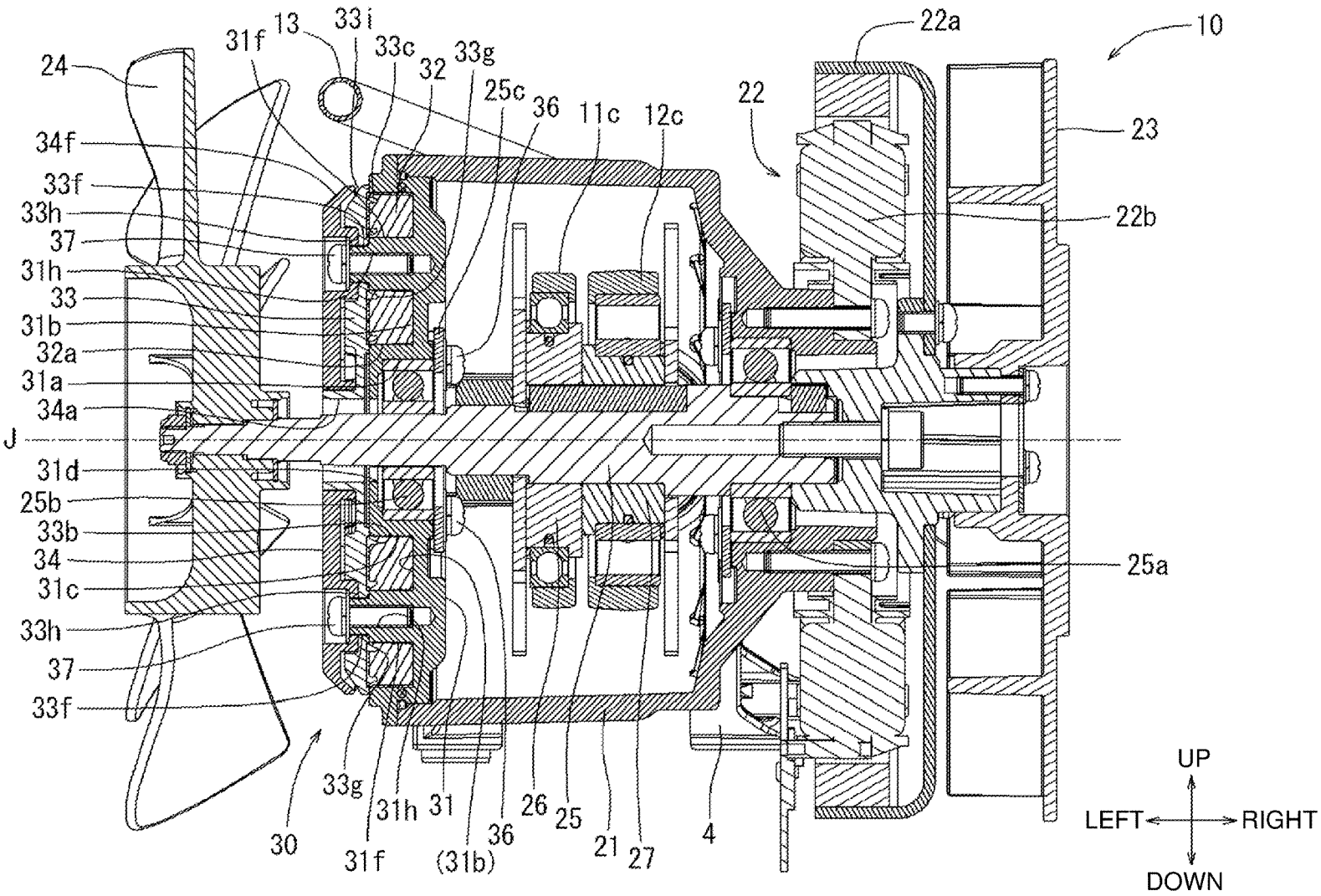
FIG. 6 is a longitudinal sectional view of the intake unit in the first embodiment, taken along line VI-VI in FIG. 5 as viewed in the direction indicated by arrows.
Figure 7:
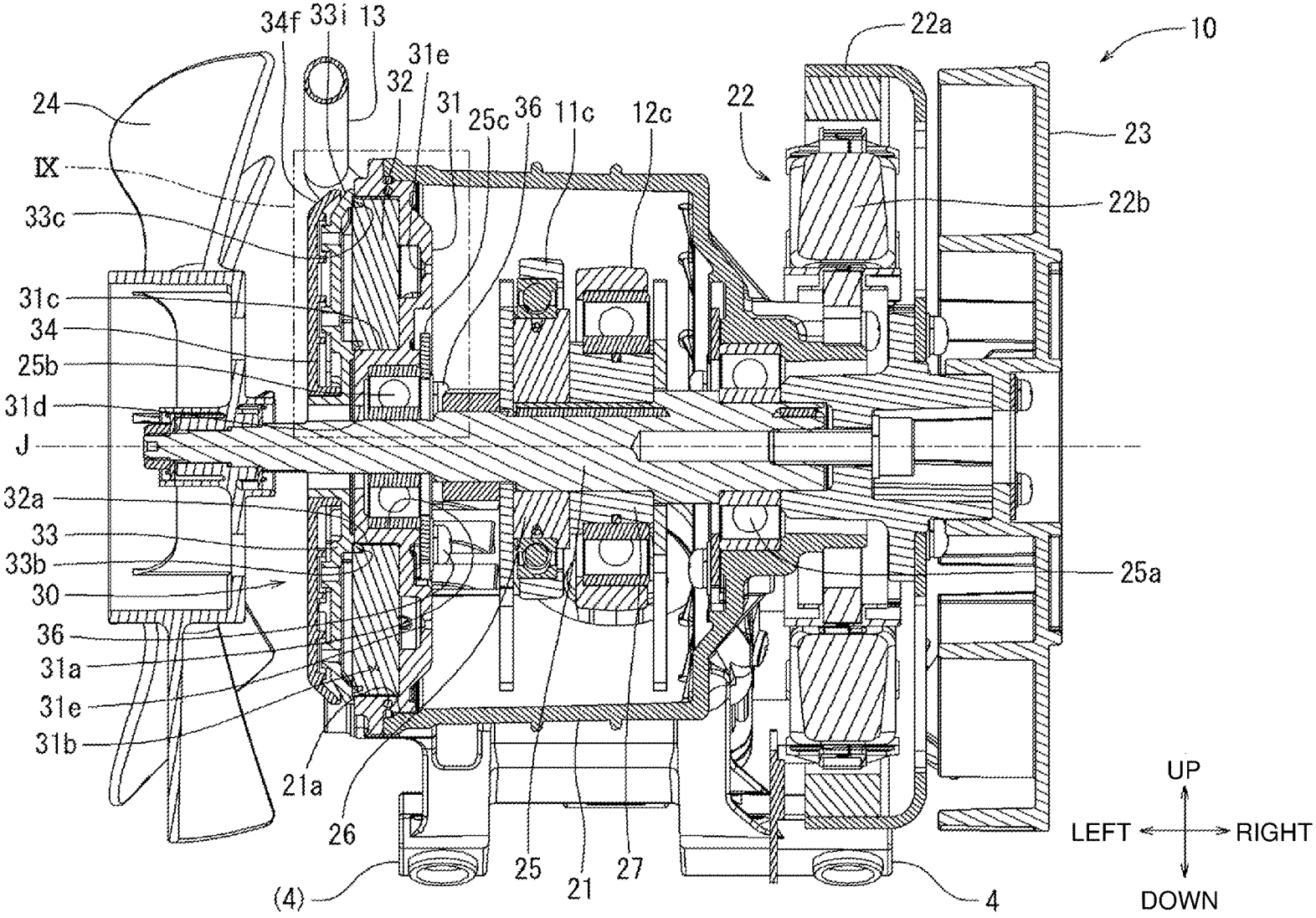
FIG. 7 is a longitudinal sectional view of the intake unit in the first embodiment, taken along line VII-VII in FIG. 5 as viewed in the direction indicated by arrows.
Figure 8:
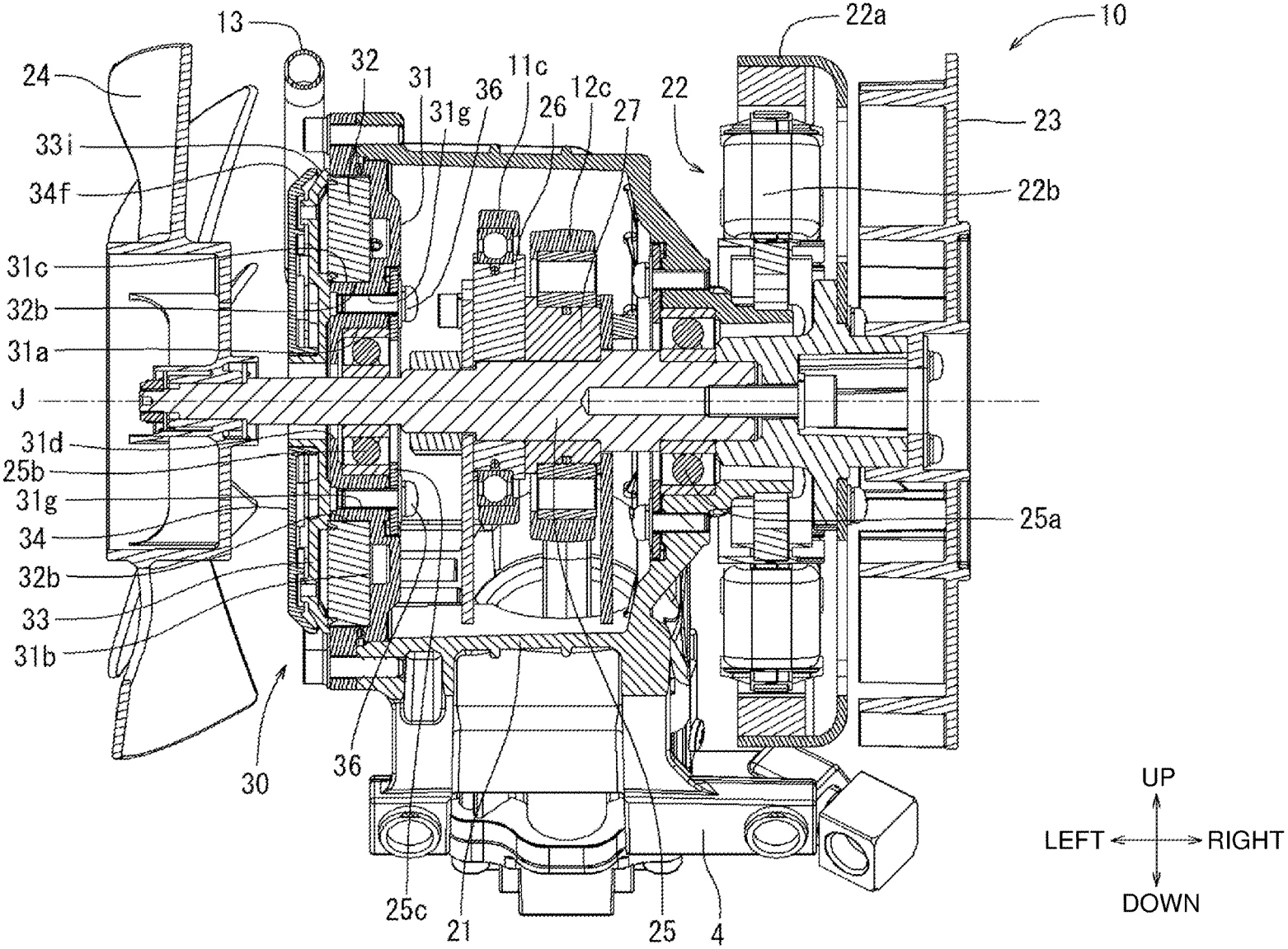
FIG. 8 is a longitudinal sectional view of the intake unit in the first embodiment, taken along line VIII-VIII in FIG. 5 as viewed in the direction indicated by arrows.

An example intake unit according to each of embodiments will be described. FIGS. 2 to 8 show the intake unit 30 in a first embodiment. FIGS. 4 to 8 show the intake unit 30 in detail. FIGS. 4 and 5 show the motor shaft 25 with the intake fan 24 removed from the motor shaft 25. In FIGS. 6 to 8, outside air flows from left to right with respect to the intake unit 30 and is drawn into the crankcase 21. The flow of intake air being upstream is hereafter also referred to as being toward an outer surface (outside), and being downstream is also referred to as being toward an inner surface (inside).

The intake unit 30 in the first embodiment includes a crankcase cover 31, a filter 32, a filter cover 33, and a dust cover 34. The crankcase cover 31 hermetically covers an intake opening 21*a* of the crankcase 21. The filter 32 covers inner inlets 31*e* in the crankcase cover 31. The filter cover 33 covers the filter 32. The dust cover 34 covers the filter cover 33.

Figure 9:
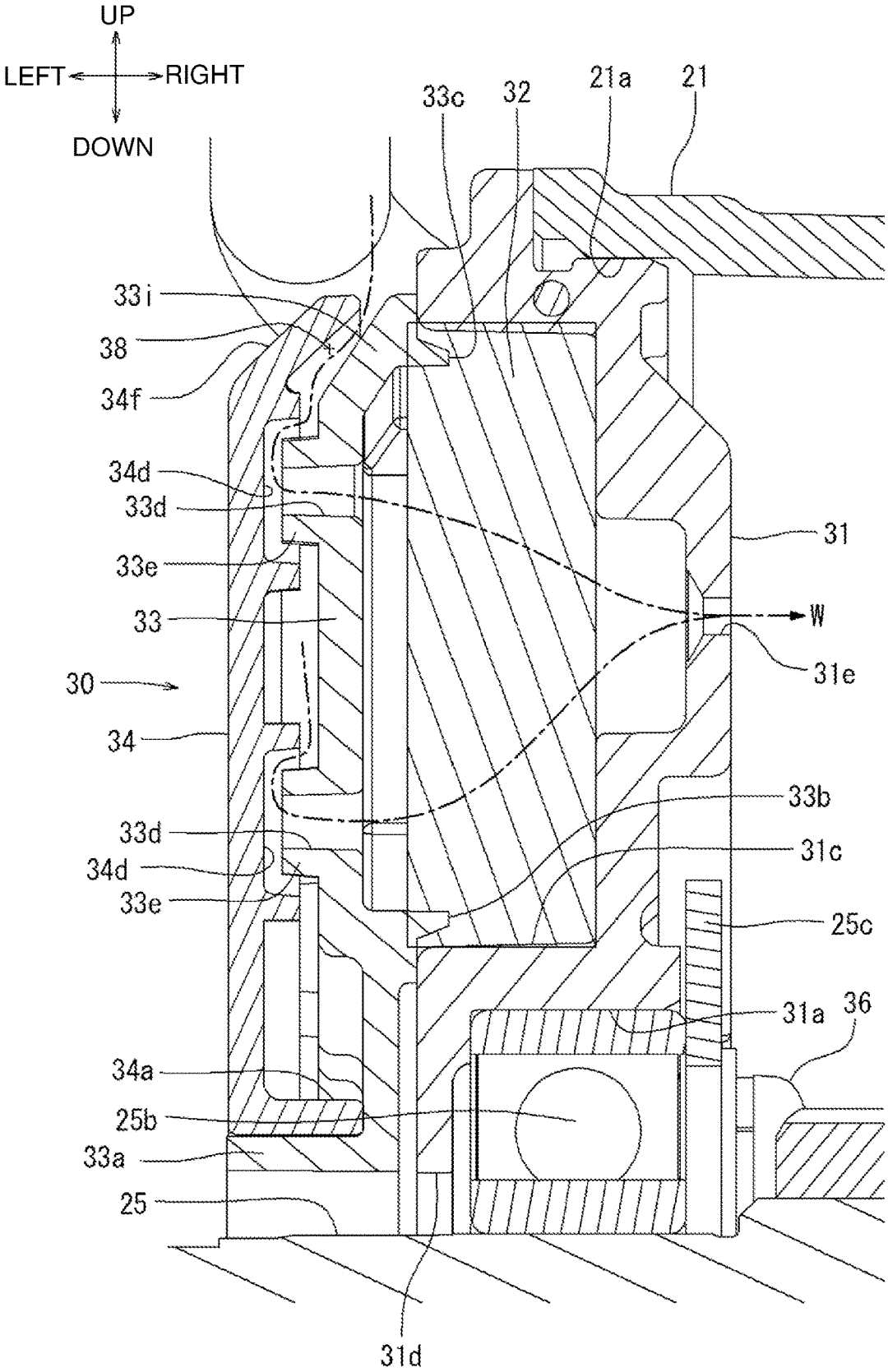
FIG. 9 is an enlarged view of portion IX in FIG. 7.
Figure 10:
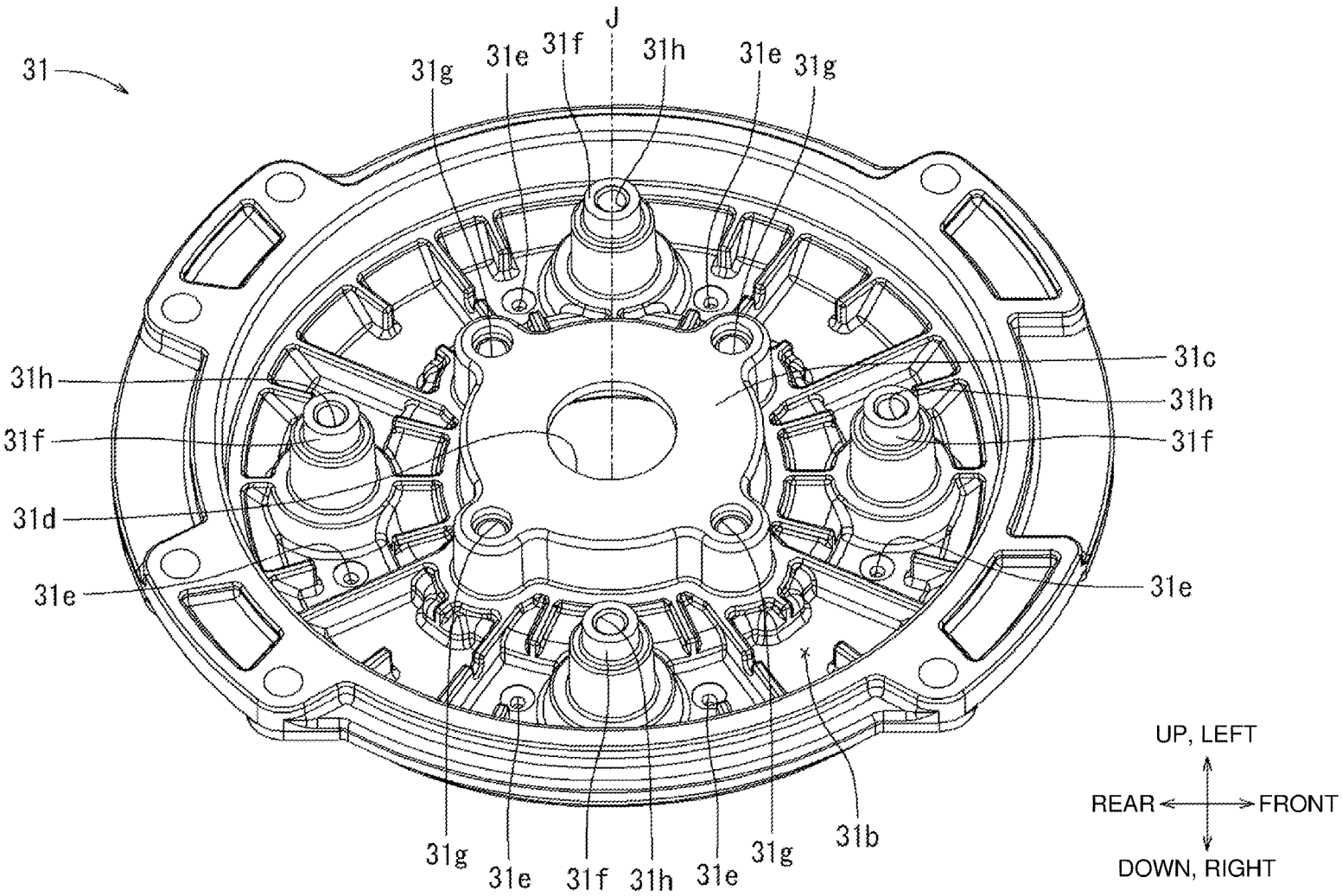
FIG. 10 is a perspective view of a crankcase cover as viewed from its outer surface.

The opening 21*a* of the crankcase 21 is substantially circular. As shown in FIGS. 5 and 9, the crankcase cover 31 is substantially disk-shaped. The crankcase cover 31 is coupled to the opening 21*a* of the crankcase 21 with six mount screws 35 in total arranged on its circumference. The crankcase cover 31 hermetically covers the opening 21*a*. The crankcase cover 31 has a cylindrical bearing recess 31*a* on a central portion of its inner surface. The bearing recess 31*a* holds the bearing 25*b*.

As shown in FIG. 8, the bearing recess 31*a* has an opening to receive a single restriction plate 25*c* fastened with four fixing screws 36. Thus, the restriction plate 25*c* covers the opening of the bearing recess 31*a*. The bearing 25*b* is held between the bottom of the bearing recess 31*a* and the restriction plate 25*c* and thus restricted from being displaced in a direction of a motor axis J.

As shown in FIGS. 5 to 8, the crankcase cover 31 has a filter-receiving recess 31*b* accommodating the filter 32 on its outer surface. The filter-receiving recess 31*b* includes a cylindrical protrusion 31*c* on its central portion. The protrusion 31*c* defines the bearing recess 31*a* on the inner surface. The protrusion 31*c* has a through-hole 31*d* at its center to receive the motor shaft 25. The protrusion 31*c* has four threaded holes 31*g* equally spaced on its periphery. The fixing screws 36 fastening the restriction plate 25*c* are screwed into the threaded holes 31*g*. The filter-receiving recess 31*b* surrounds the protrusion 31*c*.

As shown in FIGS. 5 to 7, the crankcase cover 31 has the multiple inner inlets 31*e* and multiple screw bosses 31*f* on its bottom surface. Four screw bosses 31*f* are arranged in the present embodiment. Each screw boss 31*f* has an internal thread 31*h* on its inner periphery. As described later, a fixing screw 37 is screwed onto the internal thread 31*h* on each of the four screw bosses 31*f* to fasten the filter cover 33 and the dust cover 34 together to the crankcase cover 31.

Each screw boss 31*f* protrudes leftward from the outer surface of the crankcase cover 31. Each screw boss 31*f* has a stepped outer diameter and includes a larger-diameter portion on its basal end and a smaller-diameter portion on its distal end. Each screw boss 31*f* has the inner inlets 31*e* on both sides. Eight inner inlets 31*e* are arranged in total in the present embodiment. The single filter 32 is accommodated in the filter-receiving recess 31*b* to cover the eight inner inlets 31*e* from outside.

The filter-receiving recess 31*b* is deep enough to accommodate the filter 32 substantially entirely in the thickness direction. Thus, as shown in FIGS. 6 to 8, the outer circumferential end face of the crankcase cover 31 is substantially flush with the outer surface of the filter 32.

The filter 32 is a felt filter for reducing noise and dust. The filter 32 is substantially disk-shaped. The filter 32 has a through-hole 32*a* at its center. The protrusion 31*c* on the crankcase cover 31 extends through the through-hole 32*a*. The through-hole 32*a* has four through-holes 32*b* equally spaced on its periphery. Each threaded hole 31*g* in the crankcase cover 31 extends through the corresponding through-hole 32*b*. The through-hole 32*a* is surrounded by four through-holes 32*c*. The larger-diameter portion of each screw boss 31*f* in the crankcase cover 31 extends through the corresponding through-hole 32*c*.

The filter cover 33 is coupled to the outer surface of the filter 32. The filter cover 33 is a disk having substantially the same diameter as the filter 32. The filter cover 33 covers the entire outer surface of the filter 32. The filter cover 33 includes a cylindrical insertion portion 33*a* at its center. The insertion portion 33*a* receives the motor shaft 25 on its inner circumference.

Figure 11:
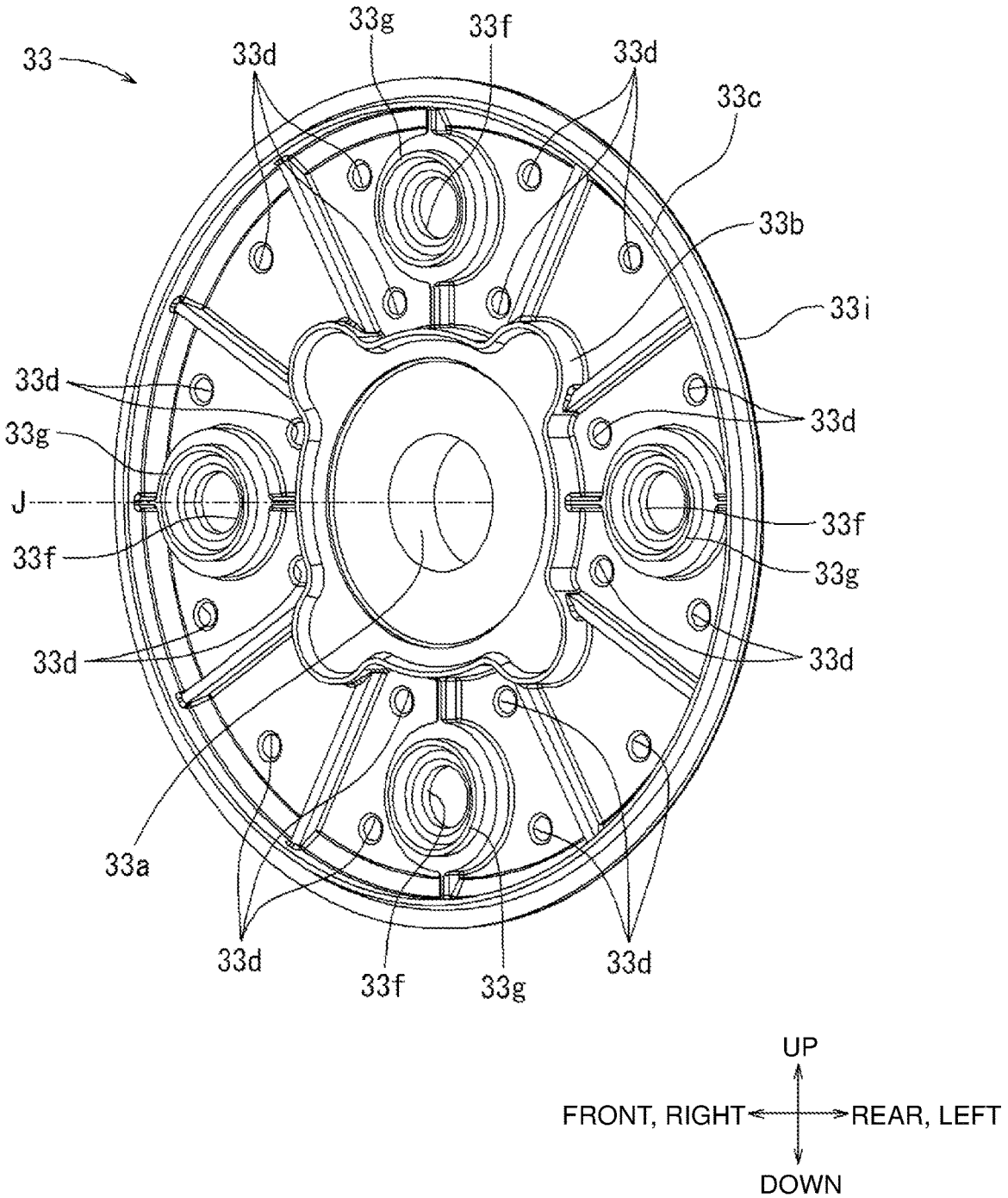
FIG. 11 is a perspective view of a filter cover as viewed from its inner surface.

As shown in FIG. 11, the filter cover 33 includes an inner circumferential holder 33*b* surrounding the insertion portion 33*a* on its inner surface. The inner circumferential holder 33*b* is a ridge protruding inward (toward the filter 32) along the peripheries of the through-holes 32*a* and 32*b* in the filter 32. The filter cover 33 also includes an outer circumferential holder 33*c* on the circumference of the inner surface. The outer circumferential holder 33*c* is a ridge protruding inward along the circumference of the filter 32. The inner circumferential holder 33*b* and the outer circumferential holder 33*c* respectively abut against the inner and outer circumferences of the outer surface of the filter 32. The filter 32 is thus less likely to be displaced in the filter-receiving recess 31*b* on the crankcase cover 31.

The filter cover 33 has multiple outer inlets 33*d*. As shown in FIGS. 5, 7, 9, and 12, the filter cover 33 includes multiple annular walls 33*e* on its outer surface. The annular walls 33*e* are cylindrical. Each annular wall 33*e* has an inner circumference defining the outer inlet 33*d* extending through the annular wall 33*e* in the thickness direction. Each outer inlet 33*d* with the corresponding annular wall 33*e* has a depth greater than its hole diameter. This reduces intake noise.

Each annular wall 33*e* enters a recess 34*d* on the dust cover 34 described later. As indicated by arrow W (intake path W) in FIG. 9, each annular wall 33*e* bends the intake path W extending in a plane direction of the filter cover 33 to extend in a thickness direction (a direction along the motor axis J). Each annular wall 33*e* is included in a path bender that bends the intake path W of outside air in the thickness direction. The outside air flowing toward the outer surface of the filter cover 33 flows through the path bent in the thickness direction by each path bender into the outer inlet 33*d*. The outside air flowing into the outer inlet 33*d* is blown toward the filter 32.

The filter cover 33 has four through-holes 33*f* equally spaced on its circumference. The smaller-diameter portion of each screw boss 31*f* in the crankcase cover 31 extends through the corresponding through-hole 33*f* As shown in FIG. 11, the filter cover 33 includes middle holders 33*g* surrounding the through-holes 33*f* on the inner surface. Similarly to the inner circumferential holder 33*b* and the outer circumferential holder 33*c*, each middle holder 33*g* is a ridge protruding toward the filter 32. The middle holders 33*g* hold middle areas in the radial direction of the filter 32.

Figure 12:
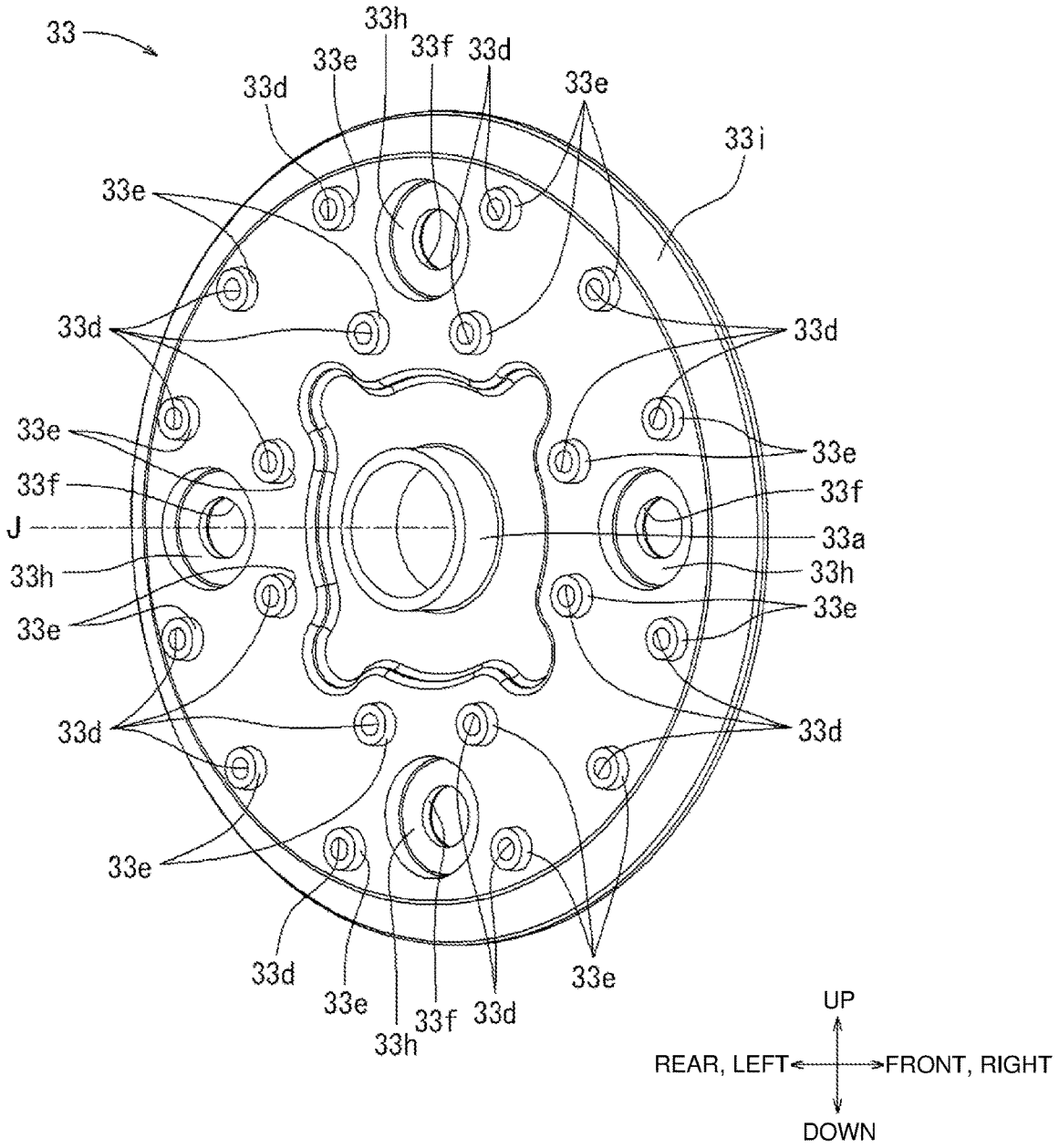
FIG. 12 is a perspective view of the filter cover as viewed from its outer surface.

As shown in FIGS. 5 and 12, the filter cover 33 has, on the outer surface, positioning recesses 33*h* each surrounding the opening of the corresponding through-hole 33*f*. Each positioning recess 33*h* is coaxial with the corresponding through-hole 33*f* and is a circular recess with a predetermined depth. Each positioning recess 33*h* receives a protrusion 34*b* on the dust cover 34. Thus, the dust cover 34 is positioned relative to the filter cover 33 about the motor axis J.

The filter cover 33 includes an outer circumferential portion 33*i* having a uniform width and bent toward the filter 32 at an angle of substantially 45° along its entire circumference.

Figure 13:
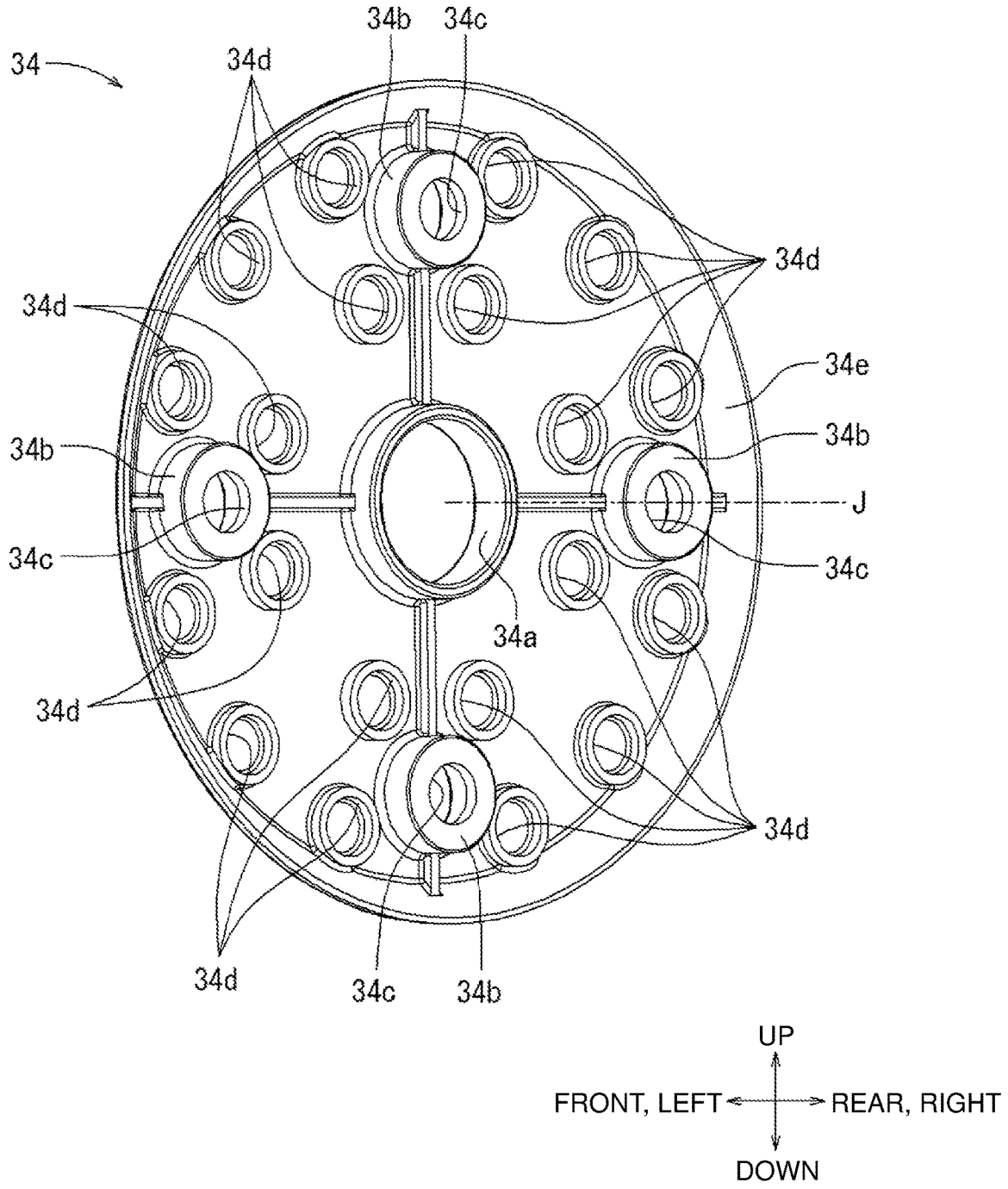
FIG. 13 is a perspective view of a dust cover as viewed from its inner surface.

As shown in FIG. 13, the dust cover 34 is a disk having substantially the same diameter as the filter cover 33. The dust cover 34 obstructs the flow of outside air produced by the intake fan 24 to prevent the outside air from being blown directly against the filter cover 33. This prevents dust or other matter contained in the outside air from being blown directly against the filter cover 33. The dust cover 34 includes a cylindrical insertion portion 34*a* in the central portion of its inner surface. The insertion portion 34*a* protrudes toward the filter cover 33. The insertion portion 33*a* of the filter cover 33 is received in the insertion portion 34*a*. The motor shaft 25 has a distal end protruding outward through the inner circumference of the insertion portion 33*a* received in the insertion portion 34*a*. The protruding distal end of the motor shaft 25 supports the intake fan 24.

As shown in FIGS. 6 to 9, the insertion portion 33*a* in the filter cover 33 is received (fitted through recess-protrusion engagement) in the insertion portion 34*a* in the dust cover 34. The filter cover 33 and the dust cover 34 are thus positioned relative to each other coaxially with the motor shaft 25.

The dust cover 34 includes the four cylindrical protrusions 34*b* equally spaced in the circumferential direction on the inner surface. The protrusions 34*b* protrude toward the filter cover 33. The four protrusions 34*b* are received in the corresponding positioning recesses 33*h* on the filter cover 33. The dust cover 34 is thus positioned relative to the filter cover 33 in the direction of the motor axis J. In the positioning state, the dust cover 34 and the filter cover 33 have a space between them in the direction of the motor axis J. The space serves as the intake path W for drawing outside air into the crankcase 21.

Each protrusion 34*b* has a through-hole 34*c* at its center. Each through-hole 34*c* receives the corresponding fixing screw 37. As shown in FIG. 5, the dust cover 34 has, on its outer surface, circular indentations 34*e* surrounding the openings of the through-holes 34*c*. The dust cover 34 has four indentations 34*e* recessed toward the inner surface and thus includes the corresponding protrusions 34*b* protruding on the backs of the indentations 34*e*.

The dust cover 34 has multiple recesses 34*d* on the inner surface. The multiple recesses 34*d* are aligned with the annular walls 33*e* on the filter cover 33. Each recess 34*d* is circular and has a diameter large enough to receive the corresponding annular wall 33*e*. Each recess 34*d* is deep enough to receive the corresponding annular wall 33*e* with a narrow space left. The space between the bottom surface of each recess 34*d* and the corresponding annular wall 33*e* defines a part of the intake path W for drawing outside air.

Each annular wall 33*e* on the filter cover 33 enters (overlaps in the direction of the motor axis J) the corresponding recess 34*d* on the dust cover 34, thus bending the intake path W at substantially right angles. This defines the intake path W with a labyrinth structure.

The dust cover 34 includes an outer circumferential portion 34*f* having a uniform width and bent toward the filter cover 33 at an angle of substantially 45° along its entire circumference. As shown in FIGS. 6 to 9, the outer circumferential portion 34*f* of the dust cover 34 and the outer circumferential portion 33*i* of the filter cover 33 thus have a uniform space between them. The space defines an inlet port 38 of the intake path W.

As shown in FIGS. 5 and 6, the dust cover 34 and the filter cover 33 are fastened together to the crankcase cover 31 with the four fixing screws 37. The larger-diameter portion of each screw boss 31*f* in the crankcase cover 31 is in the corresponding through-hole 32*c* in the filter 32. The smaller-diameter portion of each screw boss 31*f* is placed through the corresponding through-hole 33*f* in the filter cover 33 and the corresponding through-hole 34*c* in the dust cover 34. The internal thread 31*h* on each screw boss 31*f* receives the corresponding fixing screw 37 to fasten the dust cover 34 and the filter cover 33 together to the crankcase cover 31. The filter 32 is thus held inside the filter-receiving recess 31*b* on the crankcase cover 31. Each fixing screw 37 has a head in the corresponding indentation 34*e*. This prevents the heads of the fixing screws 37 from protruding from the outer surface of the dust cover 34.

In response to activation of the electric motor 22, the intake fan 24 rotates to blow outside air against the intake unit 30. As indicated by arrow Win FIG. 9, the blown outside air flows into the space (inlet port 38) between the dust cover 34 and the filter cover 33 through the inlet port between the outer circumferential portion 34*f* of the dust cover 34 and the outer circumferential portion 33*i* of the filter cover 33. The outer circumferential portion 34*f* of the dust cover 34 and the outer circumferential portion 33*i* of the filter cover 33 are bent in the same direction. Thus, the intake path W of the intake unit 30 is bent at the inlet port 38.

The outside air flowing into the space between the dust cover 34 and the filter cover 33 through the inlet port 38 is blown against the annular walls 33*e* on the filter cover 33 and flows into the recesses 34*d* on the dust cover 34. In this state, the flow of the outside air (intake path W) is bent at substantially right angles. After being bent at two positions on the intake path W, the outside air flowing into the recesses 34*d* flows into the outer inlets 33*d* (the inner circumferences of the annular walls 33*e*) and is blown against the filter 32.

The outside air passes through the filter 32 to filter dust. Clean outside air resulting from the dust filtering with the filter 32 flows into the crankcase 21 through the inner inlets 31*e* in the crankcase cover 31. Outside air flowing in through the intake path W is supplied to the first compressor 11. The outside air flowing in is supplied into the first cylinder 11*a* and compressed by the first piston 11*b*.

In the air compressor 1 according to the first embodiment, outside air flows into the outer inlets 33*d* through the inlet port 38 between the outer circumferential portion 34*f* of the dust cover 34 and the filter cover 33. Thus, the intake path W of the outside air extending in the plane direction of the filter cover 33 is bent in the thickness direction (the direction of the motor axis J) to reduce the likelihood that dust contained in the outside air is blown directly against the filter 32. The filter 32 is thus less likely to be clogged.

The path benders (annular walls 33*e*) are located between the filter cover 33 and the dust cover 34. The intake path W of the outside air passing between the filter cover 33 and the dust cover 34 is bent in the thickness direction of the filter cover 33 (the direction of the motor axis J). This reduces the likelihood that dust contained in the outside air is blown directly against the filter 32 and thus reduces clogging of the filter 32 more reliably.

Each path bender includes the annular wall 33*e* protruding from the circumference of the corresponding outer inlet 33*d* in the filter cover 33 toward the dust cover 34, and the recess 34*d* located on the dust cover 34 and receiving the annular wall 33*e*. Thus, the intake path W is bent in the thickness direction of the filter cover 33 reliably.

The dust cover 34 and the filter cover 33 are fastened together to the crankcase cover 31 with the fixing screws 37. This simplifies the connection of the dust cover 34 and the filter cover 33 to the crankcase cover 31 (crankcase 21).

The dust cover 34 has, on its outer surface, the indentations 34*e* accommodating the heads of the fixing screws 37. The dust cover 34 includes the protrusions 34*b* on the backs of the corresponding indentations 34*e* (on the inner surface). The protrusions 34*b* are received in the corresponding positioning recesses 33*h* on the filter cover 33. Thus, the dust cover 34 is positioned relative to the filter cover 33 about the motor axis J. The engagement of the protrusions 34*b* with the positioning recesses 33*h* positions the dust cover 34 relative to the filter cover 33. The dust cover 34 is thus attached easily.

The insertion portion 34*a* of the dust cover 34 receives the insertion portion 33*a* of the filter cover 33, and the filter cover 33 and the dust cover 34 are thus positioned relative to each other coaxially with the motor shaft 25. The insertion portion of the dust cover may be received on the inner circumference of the insertion portion of the filter cover.

Each outer inlet 33*d* is surrounded by the corresponding annular wall 33*e* and thus has a depth greater than the hole diameter. This prevents noise leakage in the crankcase 21, thus reducing noise in the compression assembly 10.

The first embodiment described above may be modified variously. For example, although each path bender includes the annular wall 33*e* on the filter cover 33 and the recess 34*d* on the dust cover 34 in the first embodiment, the recesses 34*d* on the dust cover 34 may be eliminated.

Although each annular wall 33*e* surrounds the corresponding outer inlet 33*d* in the filter cover 33, the dust cover 34 may include, for example, annular or curved walls protruding toward the outer inlets 33*d* as the path benders on the inner surface, instead of the annular walls 33*e* on the filter cover 33.

The inclination angles of the outer circumferential portion 33*i* of the filter cover 33 and the outer circumferential portion 34*f* of the dust cover 34 may be changed. One or both of the inclined outer circumferential portions 33*i* and 34*f* may be eliminated.

Second Embodiment

Figure 14:
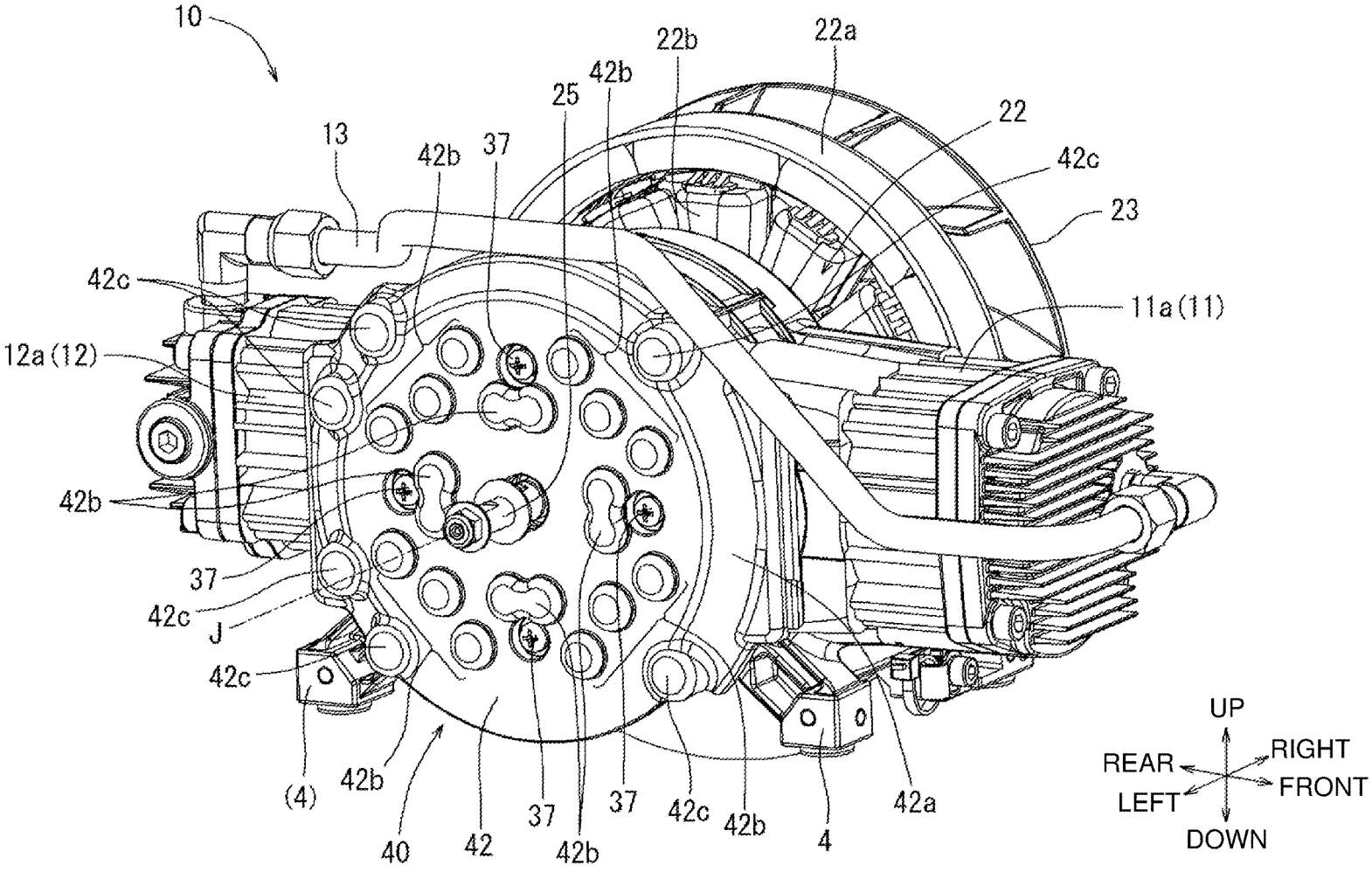
FIG. 14 is a perspective view of an intake unit in a second embodiment.
Figure 15:
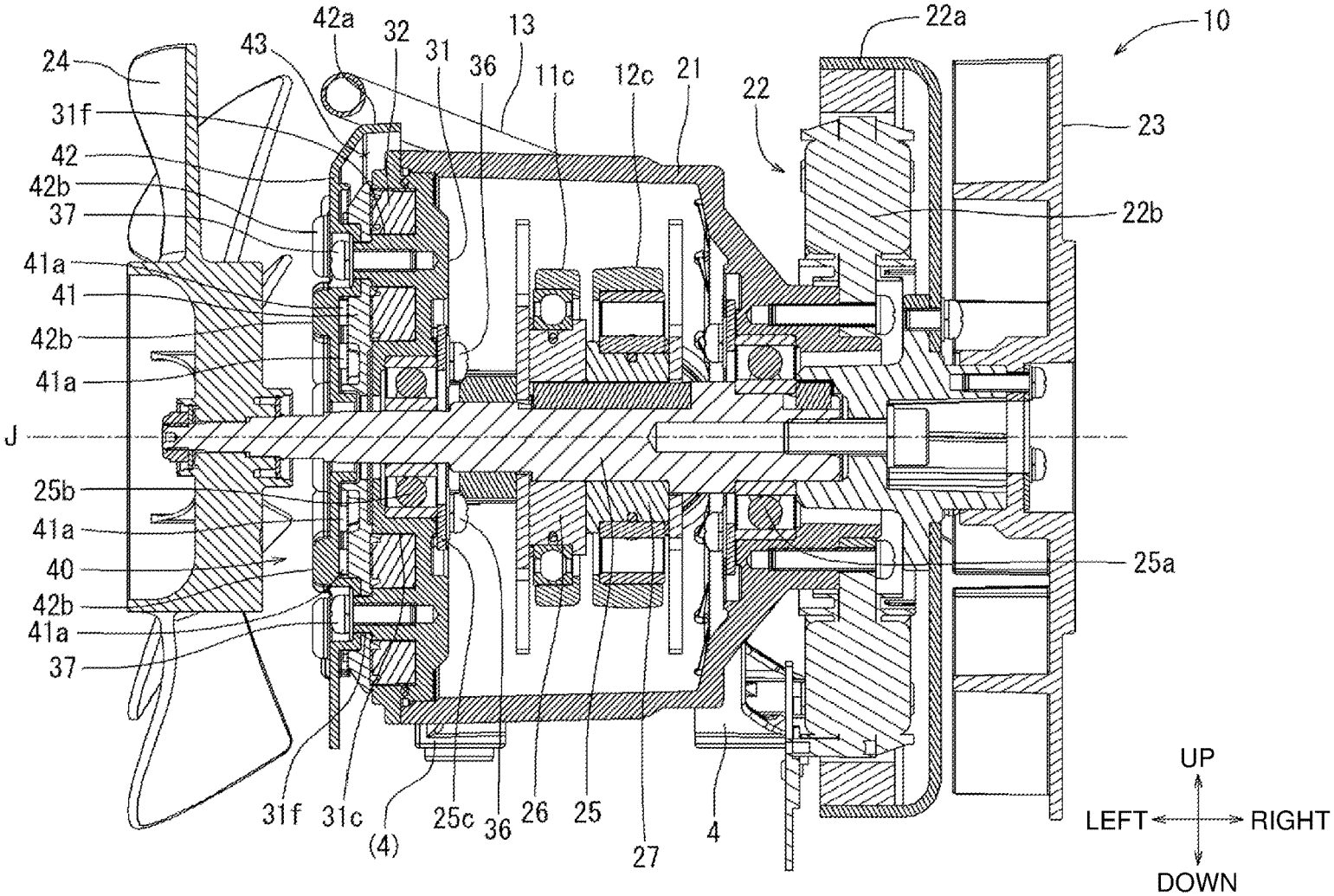
FIG. 15 is a longitudinal sectional view of the intake unit in the second embodiment.

FIGS. 14 and 15 show an intake unit 40 in a second embodiment. The air compressor 1 has the same basic structure as in the above embodiment without any modification except the intake unit 40, and the components are given the same reference numerals and will not be described. The components and the structure of the intake unit 40 that are the same as those in the first embodiment are also given the same reference numerals and will not be described.

In the second embodiment, a dust cover 42 differs from the dust cover 34 in the first embodiment. The dust cover 42 in the present embodiment has a diameter larger than the dust cover 34 in the first embodiment. The dust cover 42 includes an outer circumferential portion 42*a* bent toward the crankcase 21 at substantially 90°. The outer circumferential portion 42*a* of the dust cover 42 covers outer circumferential portions of a filter cover 41 and the crankcase cover 31 laterally.

As shown in FIG. 14, the outer circumferential portion 42*a* bent toward the crankcase 21 extends along an area about the motor axis J excluding an area of substantially 90° in a lower portion of the dust cover 42. Thus, as shown in FIG. 15, the circumferences of the filter cover 41 and the crankcase cover 31 are open downward in an area of substantially 90° in a lower portion of the intake unit 40.

In the second embodiment, the dust cover 42 includes multiple thick portions 42*b* on its outer surface. The thick portions 42*b* correspond to the recesses 34*d* (refer to FIG. 13) on the inner surface. The thick portions 42*b* thicken the bottoms of the recesses 34*d*. Thus, the recesses 34*d* are deeper, and the filter cover 41 includes annular walls 41*a* protruding by a length greater than the annular walls 33*e* in the first embodiment. Each annular wall 33*e* has an inner hole defining the outer inlet 33*d* extending through its inner surface. The longer annular walls 41*a* allow the path benders to separate dust contained in drawn outside air more reliably. The outer inlets 33*d* being deeper allow less noise in the intake unit 40.

In the second embodiment, the air compressor 1 includes multiple path benders with a labyrinth structure having a locally narrowed space between the filter cover 41 and the dust cover 42 in addition to the path benders including the annular walls 41*a* on the filter cover 41 and the recesses 34*d* on the dust cover 42.

As shown in FIG. 14, the outer circumferential portion 42*a* of the dust cover 42 includes six screw covers 42*c*. Each screw cover 42*c* covers the head of the corresponding mount screw 35. The outer circumferential portion 42*a* extends along an area of substantially 270° covering the heads of the mount screws 35 about the motor axis J.

In the second embodiment, the outer circumferential portion 42*a* of the dust cover 42 covers the outer circumferential portions of the filter cover 41 and the crankcase cover 31 laterally. Thus, when flowing into an inlet port 43 between the outer circumferential portion 42*a* of the dust cover 42 and the outer circumferential portion of the filter cover 41, outside air flows from the filter cover 41 toward the dust cover 42 (opposite to the flow direction in the outer inlets 33*d*). The intake path W of the outside air toward the dust cover 42 is thus bent in a plane direction of the filter cover 41. In the second embodiment, the outer circumferential portion 42*a* of the dust cover 42 bends the intake path W more reliably than the inlet port 38 in the first embodiment.

Third Embodiment

Figure 16:
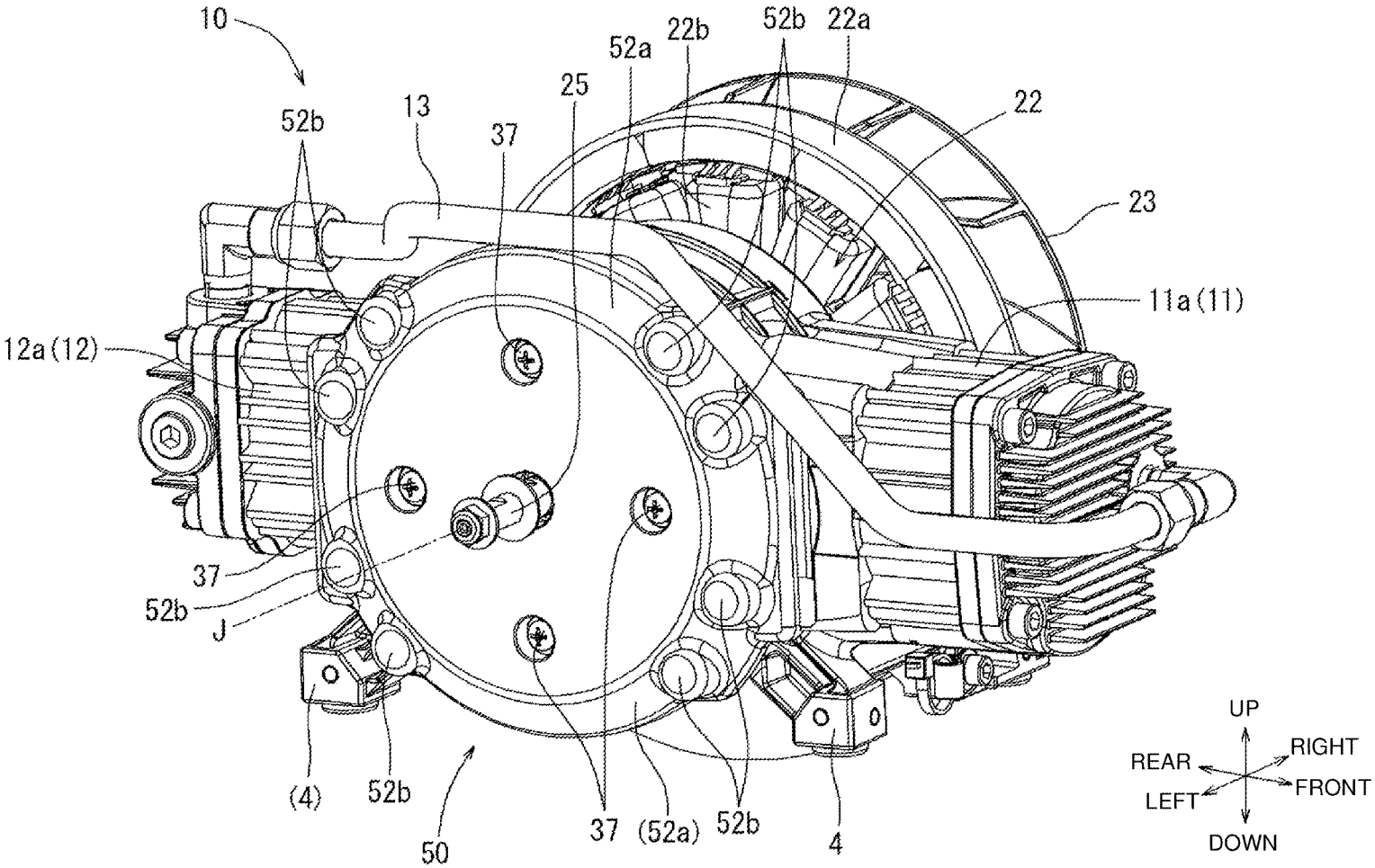
FIG. 16 is a perspective view of an intake unit in a third embodiment.
Figure 17:
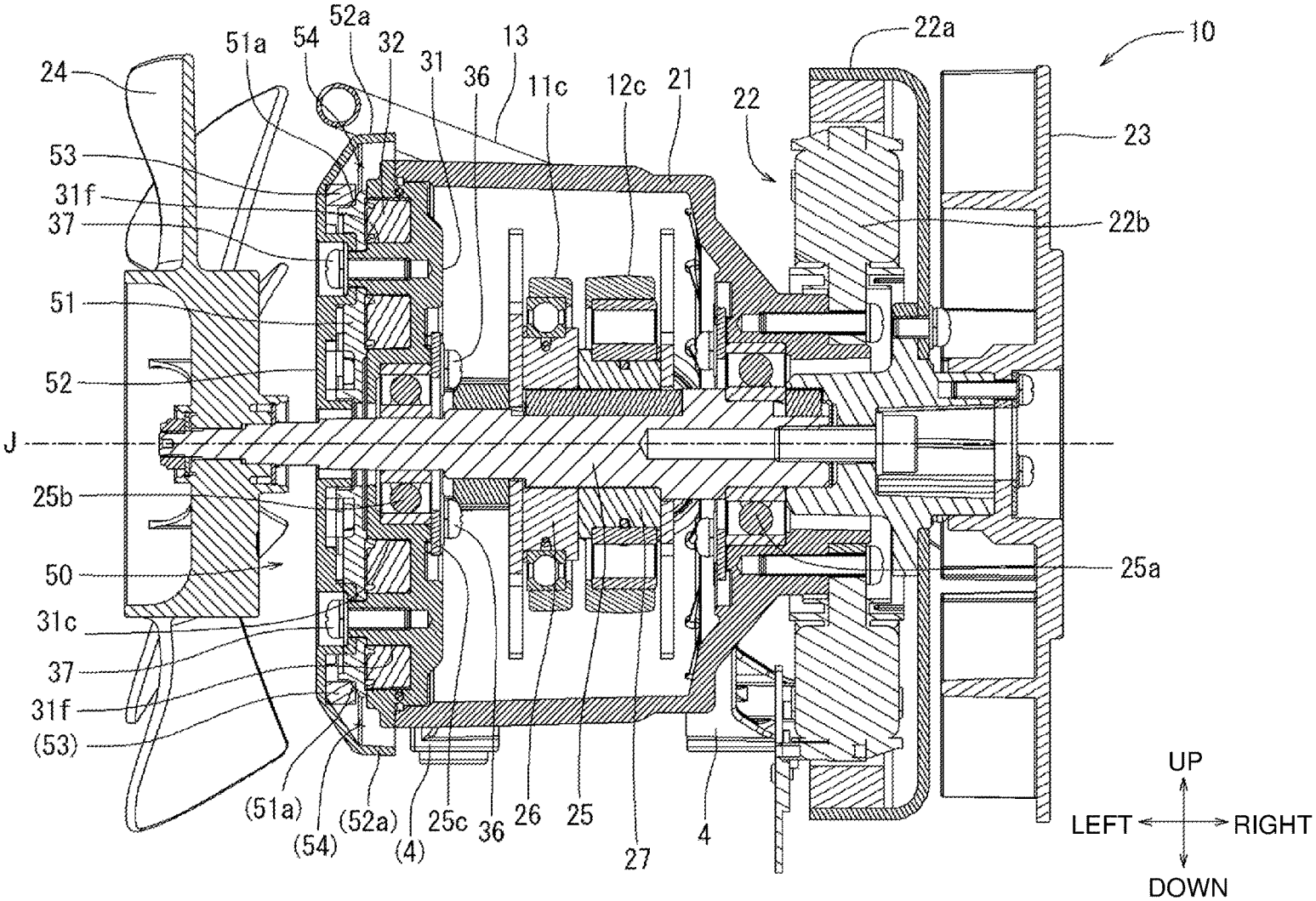
FIG. 17 is a longitudinal sectional view of the intake unit in the third embodiment.

FIGS. 16 and 17 show an intake unit 50 in a third embodiment. The components and the structures that are the same as those in the above embodiments without any modification are given the same reference numerals and will not be described. The structure in the third embodiment includes a second filter 53 in addition to the structure in the second embodiment. The second filter 53 is annular and extends along the circumference of a filter cover 51. The second filter 53 is formed from felt, similarly to the filter 32.

As shown in FIG. 17, the filter cover 51 includes a flat basal portion 51*a* along the entire circumference of its outer surface. The second filter 53 is held between the basal portion 51*a* and an inner surface of a dust cover 52. The dust cover 52 includes an outer circumferential portion 52*a* covering the circumferences of the filter cover 51 and the crankcase cover 31 laterally as in the second embodiment. The outer circumferential portion 52*a* in the third embodiment extends along the entire circumference of the dust cover 52. The outer circumferential portion 52*a* includes screw covers 52*b* covering the heads of the mount screws 35 as in the second embodiment.

Outside air is drawn through an inlet port 54 between the outer circumferential portion 52*a* of the dust cover 52 and a circumferential portion of the filter cover 51. The second filter 53 extends along the entire circumference of the inlet port 54.

In the third embodiment, the second filter 53 is installed between the filter cover 51 and the dust cover 52. This reduces clogging of the filter 32 still more reliably and also allows still less noise in the intake unit 50 (compression assembly 10).

Fourth Embodiment

Figure 18:
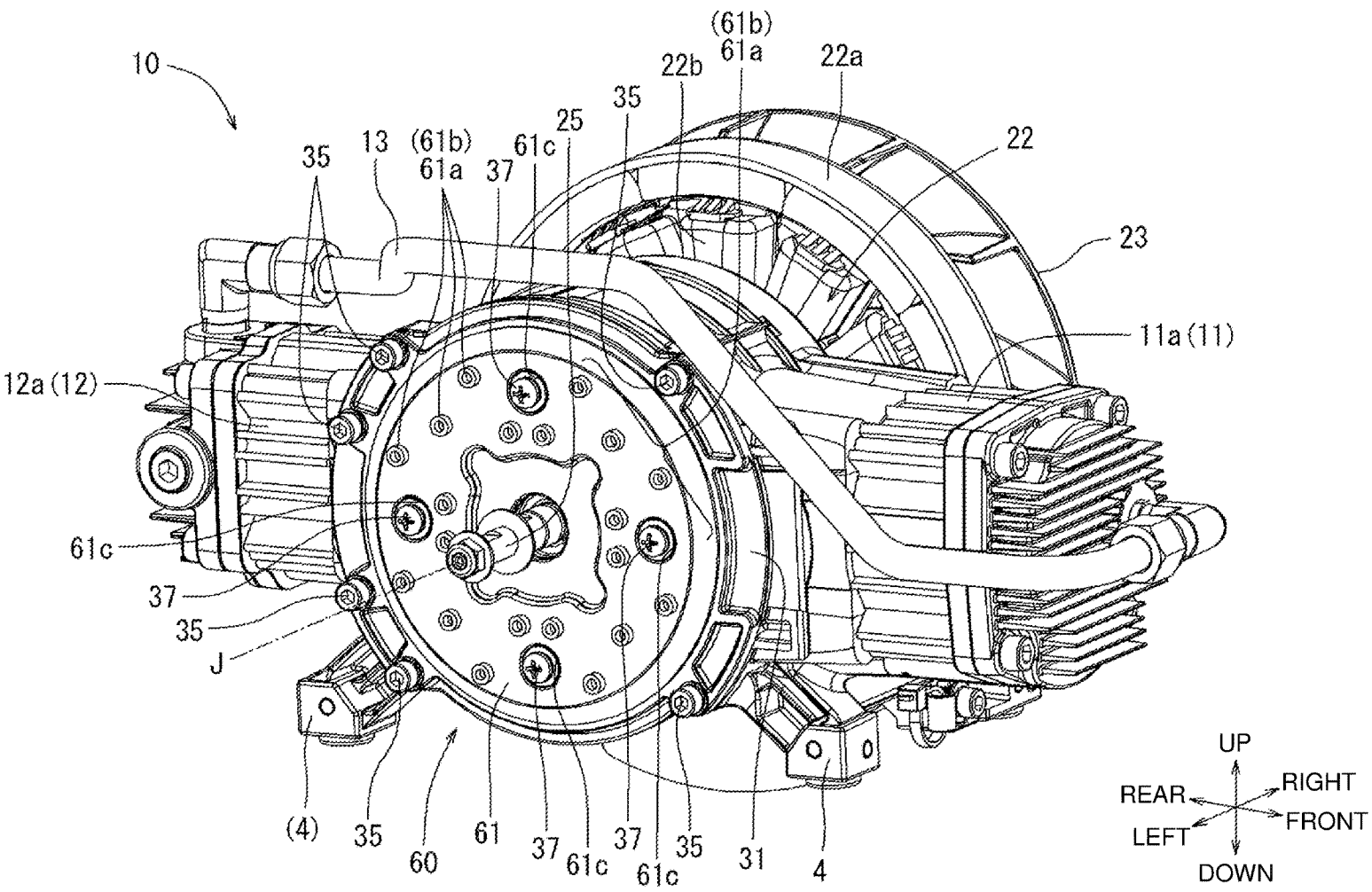
FIG. 18 is a perspective view of an intake unit in a fourth embodiment.
Figure 19:
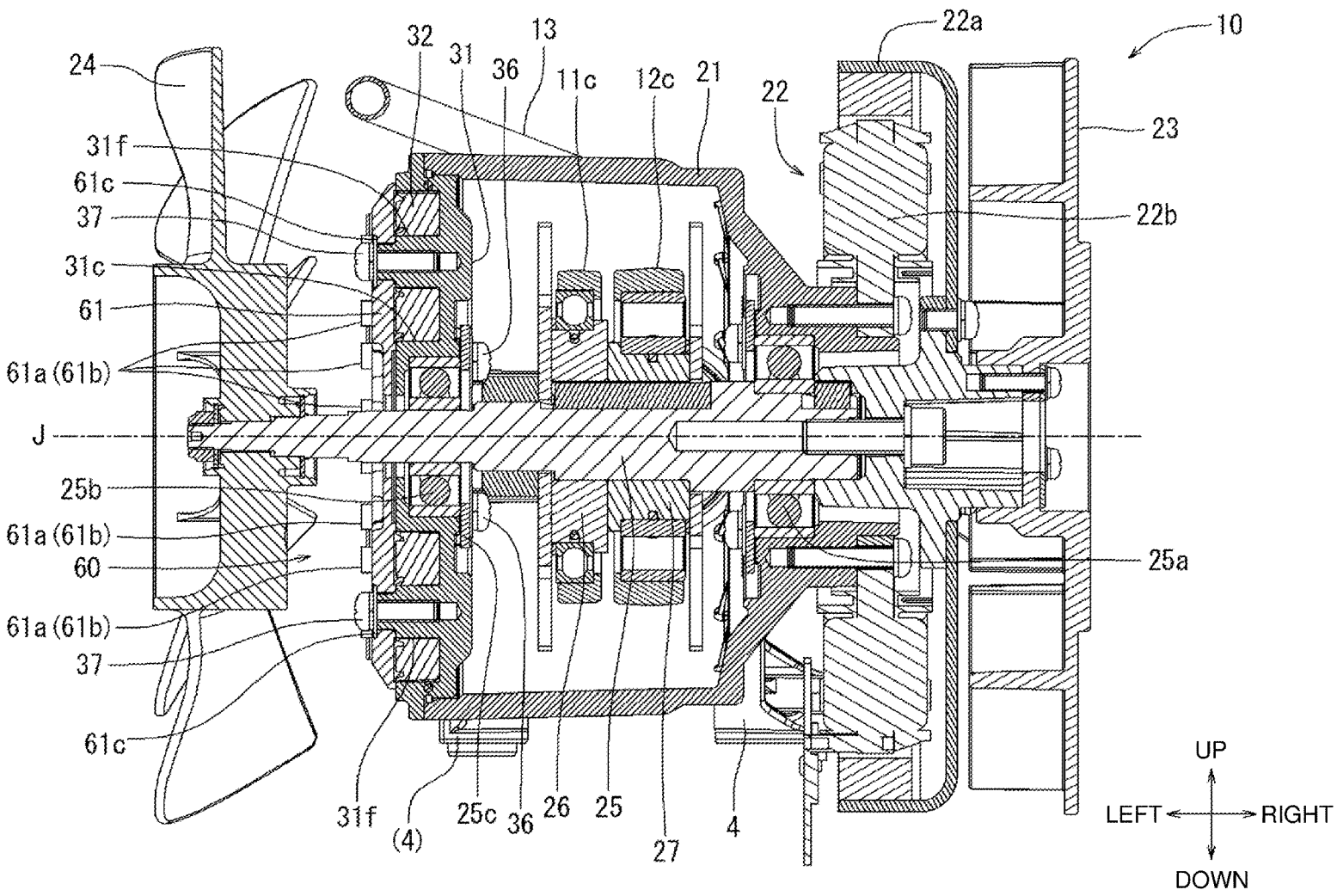
FIG. 19 is a longitudinal sectional view of the intake unit in the fourth embodiment.

FIGS. 18 and 19 show an intake unit 60 in a fourth embodiment. The intake unit 60 in the present embodiment excludes the dust cover 34 from the intake unit 30 in the first embodiment. Thus, a filter cover 61 has an exposed outer surface. As in the first embodiment, the filter cover 61 includes multiple cylindrical annular walls 61*a* on the outer surface. Each annular wall 61*a* has an outer inlet 61*b* extending through its inner surface.

The intake unit 60 has recesses 61*c* accommodating the heads of the fixing screws 37. The recesses 61*c* are shallower than the positioning recesses 33*h* in the first embodiment.

In the intake unit 60 in the present embodiment, the intake fan 24 rotates to blow outside air against the entire outer surface of the filter cover 61. The outside air is blown in a direction substantially along the motor axis J. Thus, although a portion of the outside air flows directly into the outer inlets 61*b*, the other portion of the outside air is mostly blown against the outer surface of the filter cover 61.

The outside air blown against the outer surface of the filter cover 61 flows along the outer surface and then is blown against the annular walls 61*a* to bend the intake path. The path benders remove dust from the outside air. The clean outside air with the dust removed flows into the outer inlets 61*b*.

Although the filter cover 61 is exposed, the annular walls 61*a* surrounding the corresponding outer inlets 61*b* serve as the path benders. This removes dust in the outside air effectively and reduces clogging of the filter 32.

The air compressor 1 according to any one of the first to fourth embodiments is an example of an air compressor in an aspect of the present disclosure. The compression assembly 10 in any one of the first to fourth embodiments is an example of a compression assembly in an aspect of the present disclosure. The crankcase 21 in any one of the first to fourth embodiments is an example of a crankcase in an aspect of the present disclosure. The inner inlets 31*e* in any one of the first to fourth embodiments each are an example of an inner inlet in an aspect of the present disclosure.

The filter 32 in any one of the first to fourth embodiments is an example of a filter in an aspect of the present disclosure. The filter cover 33 in the first embodiment, the filter cover 41 in the second embodiment, and the filter cover 51 in the third embodiment each are an example of a filter cover in an aspect of the present disclosure. The outer inlets 33*d* in the first embodiment and the outer inlets 33*d* in the second embodiment each are an example of an outer inlet in an aspect of the present disclosure.

The dust cover 34 in the first embodiment, the dust cover 42 in the second embodiment, and the dust cover 52 in the third embodiment each are an example of a dust cover in an aspect of the present disclosure. The outer circumferential portion 34*f* in the first embodiment, the outer circumferential portion 42*a* in the second embodiment, and the outer circumferential portion 52*a* in the third embodiment each are an example of an outer circumferential portion in an aspect of the present disclosure. The inlet port 38 in the first embodiment, the inlet port 43 in the second embodiment, and the inlet port 54 in the third embodiment each are an example of a space in an aspect of the present disclosure.

REFERENCE SIGNS LIST

1 air compressor
2 tank
3 leg
3*a* side protector
4 base
5 handle
6 body cover
7 outlet port (for high-pressure air)
7*a* adjustment dial
8 outlet port (for low-pressure air)
8*a* adjustment dial
9 operation unit
10 compression assembly
11 first compressor
11*a* first cylinder
11*b* first piston
11*c* first rod
11*d* first compression chamber
11*e* auxiliary check valve
12 second compressor
12*a* second cylinder
12*b* second piston
12*c* second rod
12*d* second compression chamber
13 supply pipe
14 first check valve
15 air channel
21 crankcase
21*a* opening
22 electric motor
22*a* rotor
22*b* stator
23 heat-dissipating fan
24 intake fan
25 motor shaft
25*a*, 25*b* bearing
25*c* restriction plate
26 first crank
27 second crank
30 intake unit (first embodiment)
W intake path
31 crankcase cover
31*a* bearing recess
31*b* filter-receiving recess
31*c* protrusion
31*d* through-hole
31*e* inner inlet
31*f* screw boss
31*g* threaded hole
31*h* internal thread
32 filter
32*a*, 32*b*, 32*c* through-hole
33 filter cover
33*a* insertion portion
33*b* inner circumferential holder
33*c* outer circumferential holder
33*d* outer inlet
33*e* annular wall
33*f* through-hole
33*g* middle holder
33*h* positioning recess
33*i* outer circumferential portion
34 dust cover
34*a* insertion portion
34*b* protrusion
34*c* through-hole
34*d* recess
34*e* indentation
34*f* outer circumferential portion
35 mount screw
36 fixing screw
37 fixing screw
38 inlet port
40 intake unit (second embodiment)
41 filter cover
41*a* annular wall
42 dust cover
42*a* outer circumferential portion
42*b* thick portion
42*c* screw cover
43 inlet port
50 intake unit (third embodiment)
51 filter cover
51*a* basal portion
52 dust cover
52*a* outer circumferential portion
52*b* screw cover
53 second filter
54 inlet port
60 intake unit (fourth embodiment)
61 filter cover
61*a* annular wall
61*b* outer inlet
61*c* recess

What is claimed is:

1. An air compressor, comprising:

a compression assembly including a piston and a cylinder, the piston being configured to reciprocate in the cylinder to produce compressed air;

an electric motor including a motor shaft extending along a first direction;

a crankcase accommodating the compression assembly and having an inner inlet to allow outside air to be drawn;

a filter located in the crankcase and covering the inner inlet from an outside of the crankcase in the first direction;

a filter cover having an outer inlet and covering the filter from an outside of the filter in the first direction; and a dust cover covering the filter cover from an outside of the filter cover in the first direction, covering the outer inlet, and including an outer circumferential portion, the outer circumferential portion and the filter cover having a space to draw the outside air radially inward between the outer circumferential portion and the filter cover.

2. The air compressor according to claim 1, further comprising:

a path bender protruding between the filter cover and the dust cover to bend an intake path of air passing between the filter cover and the dust cover in a thickness direction of the filter cover.

3. The air compressor according to claim 2, wherein the path bender includes an annular wall protruding from a circumference of the outer inlet toward the dust cover, and a recess located on the dust cover and receiving the annular wall.

4. The air compressor according to claim 1, wherein the outer circumferential portion of the dust cover covers an outer circumferential portion of the filter cover from the outside of the filter cover in a circumferential direction, and air passing between the outer circumferential portion of the dust cover and the outer circumferential portion of the filter cover flows from the filter cover toward the dust cover.

5. The air compressor according to claim 1, wherein the dust cover and the filter cover are fastened together to the crankcase with a screw.

6. The air compressor according to claim 5, wherein the dust cover has an outer surface with an indentation accommodating a head of the screw.

7. The air compressor according to claim 6, wherein:

the filter cover includes a first insertion portion through which the motor shaft extends, and a positioning recess, the dust cover includes a second insertion portion through which the motor shaft extends, the first insertion portion and the second insertion portion are fitted with each other through recess-protrusion engagement, and the filter cover and the dust cover each are positioned coaxially with the motor shaft, the dust cover includes a protrusion protruding toward the filter cover on a back of the indentation, and the protrusion is received in the positioning recess and positions the filter cover and the dust cover about the motor shaft relative to each other.

8. The air compressor according to claim 1, further comprising:

a second filter between the filter cover and the dust cover.

9. The air compressor according to claim 1, wherein the outer inlet has a depth greater than a hole diameter of the outer inlet.

10. The air compressor according to claim 2, wherein the outer circumferential portion of the dust cover covers an outer circumferential portion of the filter cover from the outside of the filter cover in a circumferential direction, and air passing between the outer circumferential portion of the dust cover and the outer circumferential portion of the filter cover flows from the filter cover toward the dust cover.

11. The air compressor according to claim 3, wherein the outer circumferential portion of the dust cover covers an outer circumferential portion of the filter cover from the outside of the filter cover in a circumferential direction, and air passing between the outer circumferential portion of the dust cover and the outer circumferential portion of the filter cover flows from the filter cover toward the dust cover.

12. The air compressor according to claim 2, wherein the dust cover and the filter cover are fastened together to the crankcase with a screw.

13. The air compressor according to claim 3, wherein the dust cover and the filter cover are fastened together to the crankcase with a screw.

14. The air compressor according to claim 4, wherein the dust cover and the filter cover are fastened together to the crankcase with a screw.

15. The air compressor according to claim 2, further comprising:

a second filter between the filter cover and the dust cover.

16. The air compressor according to claim 3, further comprising:

a second filter between the filter cover and the dust cover.

17. The air compressor according to claim 4, further comprising:

a second filter between the filter cover and the dust cover.

18. The air compressor according to claim 5, further comprising:

a second filter between the filter cover and the dust cover.

19. The air compressor according to claim 6, further comprising:

a second filter between the filter cover and the dust cover.

20. The air compressor according to claim 7, further comprising:

a second filter between the filter cover and the dust cover.

* * * * *